US005214436A

United States Patent [19]

Hannan

[11] Patent Number: 5,214,436

[45] Date of Patent: May 25, 1993

[54] AIRCRAFT ANTENNA WITH CONING AND BANKING CORRECTION

[75] Inventor: Peter W. Hannan, Smithtown, N.Y.

[73] Assignee: Hazeltine Corp., Greenlawn, N.Y.

[21] Appl. No.: 841,901

[22] Filed: Feb. 25, 1992

Related U.S. Application Data

[63] Continuation of Ser. No. 529,836, May 29, 1990, abandoned.

[51] Int. Cl.[5] ..... H01Q 1/280; H01Q 13/100; H01Q 9/300; H01Q 3/220

[52] U.S. Cl. ..... 343/705; 343/770; 343/826; 343/853; 343/893

[58] Field of Search ..... 343/705, 768, 770, 708, 343/853, 767, 826, 844, 876, 893, 831, 824, 722; 342/374

[56] References Cited

U.S. PATENT DOCUMENTS

| | | | |
|---|---|---|---|
| 3,255,450 | 6/1966 | Butler | 343/853 |
| 3,307,188 | 2/1967 | Marchetti et al. | 343/876 |
| 3,404,396 | 10/1968 | Buehler et al. | 343/708 |
| 3,530,485 | 9/1970 | Radford | 343/815 |
| 3,531,803 | 9/1970 | Rosen et al. | 342/374 |
| 3,560,975 | 2/1971 | Manuali | 343/705 |
| 3,652,978 | 3/1972 | Halliday et al. | 342/372 |
| 3,653,057 | 3/1972 | Charlton | 343/876 |
| 3,680,113 | 7/1972 | Dorier et al. | 342/374 |
| 3,737,906 | 6/1973 | Maynard | 343/705 |
| 3,922,685 | 11/1975 | Opas | 343/876 |
| 3,964,067 | 6/1976 | Lucas | 343/853 |
| 4,129,870 | 12/1978 | Toman | 342/372 |
| 4,321,605 | 3/1982 | Lopez | 343/844 |
| 4,797,680 | 1/1989 | Smethers, Jr. | 343/705 |
| 4,924,235 | 5/1990 | Fujisaka et al. | 342/374 |

FOREIGN PATENT DOCUMENTS

| | | |
|---|---|---|
| 3315685 | 10/1984 | Fed. Rep. of Germany . |
| 3315686 | 10/1984 | Fed. Rep. of Germany . |
| 2236289 | 1/1976 | France . |

*Primary Examiner*—Rolf Hille
*Assistant Examiner*—Peter Toby Brown
*Attorney, Agent, or Firm*—E. A. Onders

[57] ABSTRACT

Array antennas for aircraft use have a shiftable center of radiation. The antenna beam of a group of laterally spaced array antennas is steered and the beam shape is controlled by relative shifting of the centers of radiation of the arrays. Beam tilting in a fuselage mounted system of array antennas uses controlled selection of active antennas.

38 Claims, 12 Drawing Sheets

AIRCRAFT ANTENNA WITH CONING AND BANKING CORRECTION

This is a continuation of copending application Ser. No. 07/529,836 filed on May 29, 1990, now abandoned.

BACKGROUND OF THE INVENTION

The present invention relates to array antennas and multiple array systems for radiating and receiving electromagnetic signals and, in particular, to antennas adapted for use on aircraft which permit the antenna beam to be steered in azimuth or tilted, or both.

DESCRIPTION OF RELATED ART

Identification Friend or Foe (IFF) systems are used to enable aircraft to transmit and receive signals for identification of other aircraft. Airborne radar systems are also used for target location without identification capabilities. The higher frequencies typically used for airborne radar permit use of antennas providing reasonable beam resolution both vertically and horizontally. Airborne linear array antennas used for IFF may, by contrast, lack the capability of providing significant vertical resolution. Without vertical, or elevation, resolving capability, no elevation information is provided by the system. Furthermore, the straight vertical fan beam that the antenna provides in the on-boresight direction perpendicular to the linear array becomes curved or conical in shape when the beam is scanned off boresight. As a result, as illustrated in FIG. 1, if a target exists at a location (a) (15° right and at the same altitude as the reference aircraft) the IFF display would accurately indicate a target at 15° right. If however, a target were at location (b) (again 15° right, but at a higher altitude) the IFF display would indicate a target at azimuth (c), displaced from the actual 15° position of the target. The error is introduced by a "coning" of the antenna beam as it is scanned to the right and effectively assumes a profile of a form shown by curved line (d). The resulting errors introduced by off-boresight coning of the IFF beam, in addition to affecting the accuracy of the IFF target display, can introduce a displacement between the IFF and radar returns displayed for the same target.

Additional errors are introduced as a result of aircraft banking. In the absence of accurate elevation information, the azimuth of a target cannot be accurately determined as the banking maneuver tilts the antenna beam away from the horizontal reference.

Objects of the invention are, therefore, to provide improved array antennas and antenna systems, suitable for use on aircraft, which permit the antenna beam to be steered in azimuth, or tilted to compensate for banking, or both.

SUMMARY OF THE INVENTION

In accordance with the present invention, a switchable array antenna, with a plurality of antenna elements arranged for excitation in subsets of at least three elements, includes terminal means for coupling signals and a plurality of antenna elements each comprising a linear array of at least four elements arranged for use in subsets each having first, second and third elements. First excitation means, coupled to the terminal means, includes signal transmission means for coupling forward and rear element signal components of predetermined relative phase and amplitude to first and third elements by way of a point of common voltage. Second excitation means, coupled to the terminal means, includes means for coupling to a second element a middle element signal component of predetermined phase and amplitude relative to signal components coupled to the first and third elements. The antenna also includes shifting means for selectively coupling the first and second excitation means to subsets of said antenna elements so that forward, middle and rear signal components can be respectively shifted to different first, second and third element subsets of the plurality of antenna elements.

Also in accordance with the invention, a steerable antenna array system includes a plurality of switchable array antennas spaced laterally in relation to a first radiation direction, each such array antenna comprising a linear array of antenna elements, excitation means for coupling signal components of predetermined relative phase and amplitude to selected antenna elements, and shifting means coupled to said excitation means for altering the coupling of signal components to the antenna elements so as to selectively shift the effective radiation center of each array antenna along its length. The antenna system also includes azimuth control means, coupled to said array antennas, for selectively controlling the shifting means of respective antennas.

Further in accordance with the invention, a beam tilt antenna array system includes terminal means for coupling signals, a plurality of switchable array antennas such as described above and beam tilt control means for coupling a selected plurality of the array antennas to the terminal means. A beam tilt antenna array system may additionally include azimuth control means, coupled to the array antennas, for selectively controlling the shifting means of the antennas, whereby the antenna beam of the antenna system can be independently steered in azimuth and tilted.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Referring now to FIG. 2, there is shown the physical configuration of an array antenna 10 as disclosed in the inventor's copending application entitled "Array Antenna With Forced Excitation," filed Dec. 28, 1989, Ser. No. 07/458,220. An understanding of antennas of this type is important to an understanding of the present invention, which provides further improvements in such antennas and systems utilizing them. The present invention is more specifically described under the heading "Description of FIGS. 15–22."

Figure 2A:
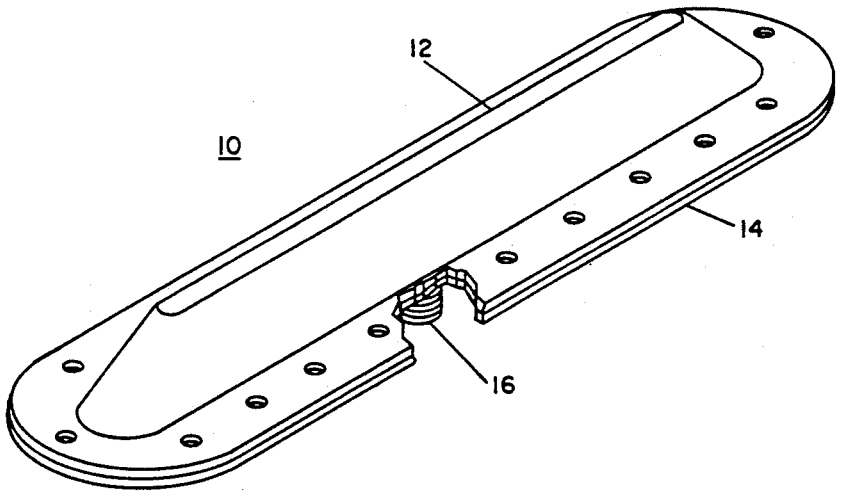
FIGS. 2*a*, 2*b* and 2*c* show orthogonal and simplified exploded views of a low-profile array antenna containing three antenna elements.

FIG. 2*a* is an orthogonal view of the complete antenna including protective cover 12, of a radiation transmissive material such as fiberglass or a suitable plastic, base member 14, of metal or suitable conductive material to serve as a mounting flange and ground plane connection, and terminal means 16, shown as a coaxial connector suitable for coupling RF signals.

Figures 2B, 2C:
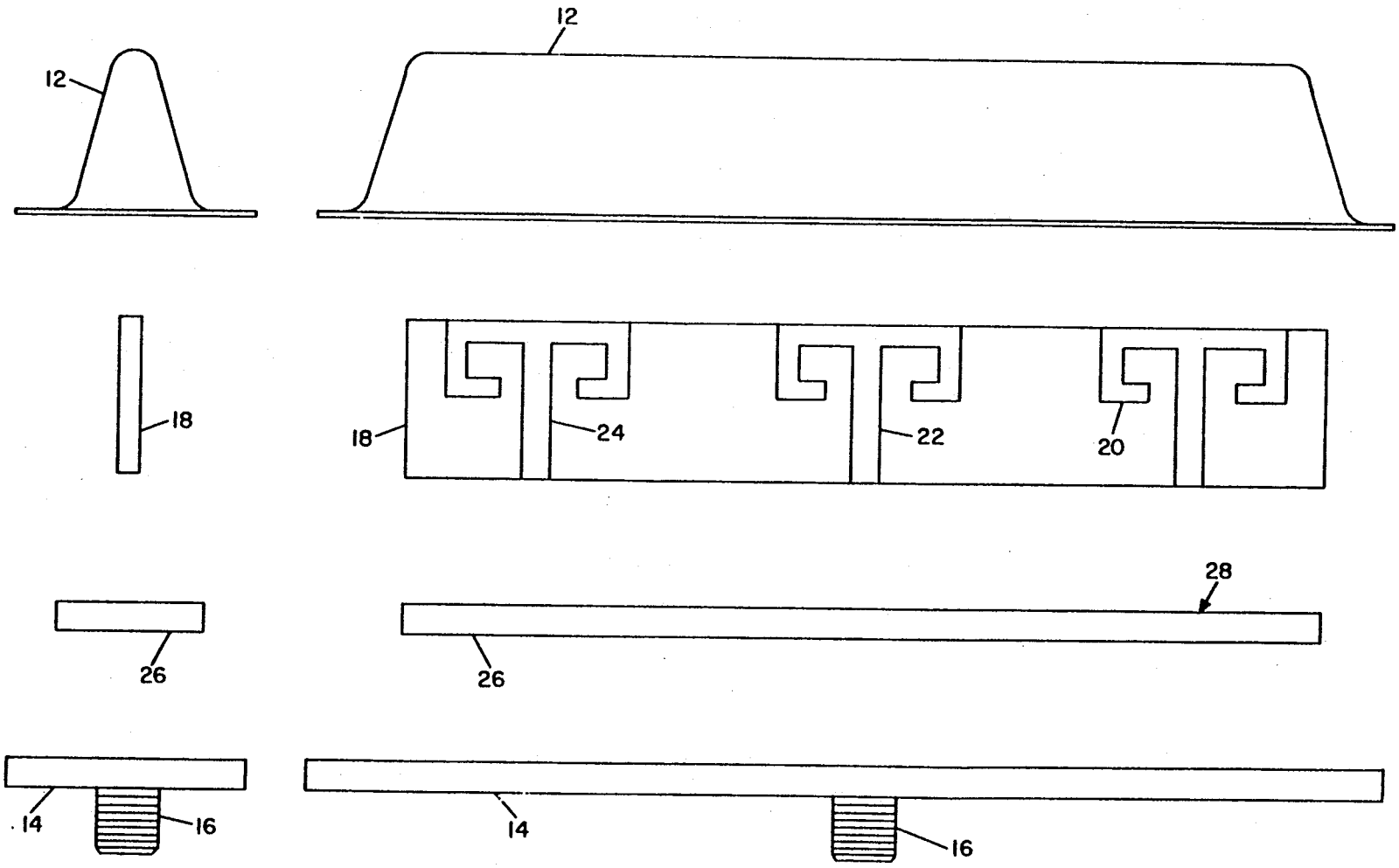

FIGS. 2*b* and 2*c* are exploded end and side views, respectively, of the array antenna 10, showing cover 12 and base member 14 with connector 16 attached. Also shown are a first printed circuit card 18 bearing a first planar conductor pattern of forward, middle and rear monopole antenna elements 20, 22 and 24, respectively, and a second printed circuit card 26 bearing a second planar conductor pattern on surface 28. The conductor pattern on surface 28, which is not visible in these views, will be described below.

In a specific embodiment of the antenna 10, the assembled combination of the cover 12 and base 14 have a height of approximately one-tenth wavelength and length of about three-quarter wavelength. References to dimensions measured in wavelength refer to approximately the average design frequency, so that for a design frequency range or bandwidth of 1,020 to 1,100 MHz, for example, the average design frequency would be 1,060 MHz, corresponding to a wavelength of about 11.1 inches. Dimensions are stated in order to characterize the invention and differentiate over prior art antennas, and are not intended to suggest that the invention is limited to precise dimensions or to exclude antennas representing appropriate applications of the invention. As shown in FIG. 2, the lower surface of base member 14 is flat, but in other embodiments it may be a curved surface corresponding to the curved surface of an aircraft to which it is to be mounted. For mounting, screws are typically fastened through the mounting holes shown in FIG. 2*a* and a clearance hole through the outer surface of the aircraft is provided for the connector 16, so that it can be joined to a mating connector for coupling signals to cabling and signal processing equipment carried within the aircraft.

Figure 3:
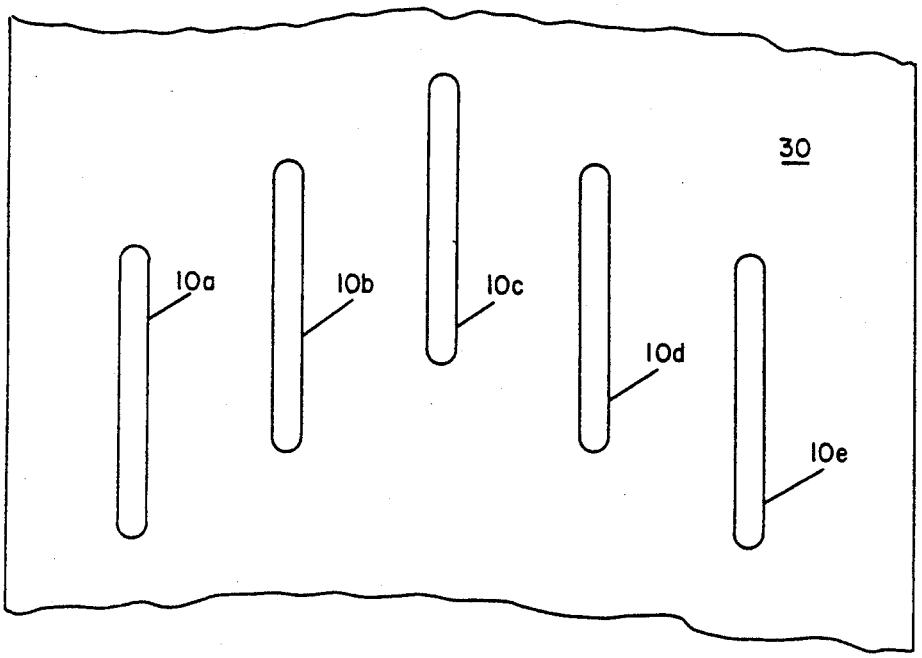
FIG. 3 shows an array antenna system including five FIG. 2 array antennas.

FIG. 3 shows a typical antenna system including five array antennas, 10*a*, through 10*e*, supported in a laterally spaced configuration on a curved metal surface 30 such as the fuselage of an aircraft, forward of the pilot's windshield. It will be apparent that in such an installation, use of array antennas one inch in height provides a dramatic improvement in the pilot's visibility, as compared to use of prior art antennas three inches in height. In an installation of this type, the individual array antennas can be excited in groupings selected to provide desired antenna beam characteristics, in accordance with known principles of array antenna excitation. An antenna system as shown in FIG. 3, when installed on the upper forward surface of an aircraft, can provide broad horizontal coverage forward of the aircraft and good vertical coverage, except below the aircraft. A similar antenna system installed on the lower forward surface of the aircraft would permit full vertical and horizontal coverage forward of the aircraft. Alternatively, antenna systems mounted near the leading edge of a wing could provide complete vertical coverage, but would probably require similar systems on the other wing in order to provide complete horizontal coverage free of blockage by the nose of the aircraft.

Figure 4:
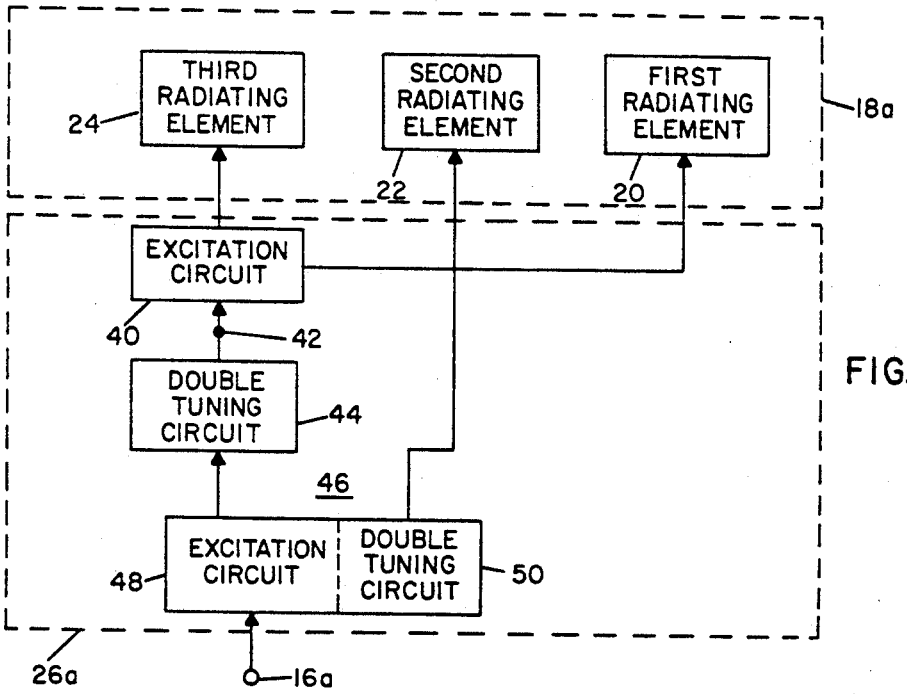
FIG. 4 is a block diagram of an array antenna containing three antenna elements.

FIG. 4 is a simplified block diagram of an array antenna in accordance with the invention, shown in two sections 18*a* and 26*a* corresponding basically to the printed circuit cards 18 and 26 in FIG. 2. The antenna is used to alternatively radiate and receive signals, in the range of 1,020 MHz to 1,100 MHz, which are coupled to and from the antenna by way of the terminal means 16*a* corresponding to connector 16 in FIG. 2. The cover and base components, 12 and 14, are not represented in FIG. 4. As noted, the antenna is used both to radiate and receive signals, and description of how signals are processed by various portions of the antenna when radiating, for example, will be understood to be equally relevant in a reverse relationship during reception.

The FIG. 4 antenna includes first, second and third antenna elements 20, 22 and 24, which in accordance with the invention may be monopoles of the order of one-tenth wavelength in height arranged in a spaced linear array. While the desirability of using antenna elements one-tenth wavelength high as compared to prior art elements one-quarter wavelength high may be readily apparent, the severe operational bandwidth degradation normally associated with short antenna elements such as monopoles has been a limiting factor contributing to the continuing reliance on quarter wave elements in the prior art. In addition, attempts to use elements shorter than a quarter wavelength in an array configuration with prior art excitation arrangements have been subject to severe effects of intercoupling between adjacent and other combinations of the antenna elements and nearby surfaces, as a result of effects of unequal and complex mutual impedances between individual antenna elements in an array. These effects, which do not readily yield to design compensation, largely determine the actual currents in the antenna elements and the resulting antenna pattern. It will be appreciated that if the currents in the various elements cannot be accurately determined and proportioned, neither can a desired antenna pattern be provided. While the basic description of the invention will be in the context of arrays of three elements, denoted as "first, second and third" elements, additional elements may be included as will be described. However, regardless of the total number of antenna elements, each antenna will include three elements meeting the description and function of the first, second and third elements as set out and claimed.

Section 26a of the FIG. 4 antenna as shown comprises excitation and tuning means which are effective to cause signal currents in the antenna elements 20, 22 and 24 to have a predetermined relationship of phase and amplitude substantially independent of impedance interaction, and are able to accomplish this over a significant band or range of operating frequencies. As shown, antenna portion 26a includes first excitation means shown as excitation circuit 40, coupled between terminal 16a and the first and third elements 20 and 24, comprising signal transmission means (as will be discussed in more detail with reference to FIG. 6) for coupling signal components to elements 20 and 24 by way of a point of common voltage, shown as point 42 on the connection between excitation circuit 40 and double tuning circuit 44. Tuning circuit 44, provides double tuning of the impedance characteristics of the antenna circuits to optimize for operation in a desired frequency range. While circuit 44 is shown as being connected in series between terminal 16a and point 42, its function is to provide wideband impedance matching and it may comprise discrete or distributed reactances coupled to point 42 in series as shown, or in parallel to ground, or may utilize appropriate lengths of transmission line, as will be apparent to those skilled in the art. Section 26a also includes means 46 shown as including second excitation circuit 48, coupled between terminal 16a and second element 22, comprising means for coupling a signal component to the element 22 which has a predetermined phase and amplitude relative to the components coupled to elements 20 and 24 via first excitation means 40. As shown in FIG. 4, excitation circuit 48 functions as a power divider coupling a portion of the input signal from terminal 16a to element 22, while the remaining portion of the input signal flows from the terminal 16a to the other elements. This power divider function of circuit 48 may be provided by a directional coupler (as will be discussed with reference to FIG. 6) or other means. In FIG. 4, means 46 also includes double tuning circuit 50 for providing double tuning of the impedance characteristics of the middle element 22 for operation in a desired frequency band or range. Where distributed reactances or transmission lines in excitation means 48 are used to provide the double tuning function, means 50 may not appear as a discrete element.

Figure 5:
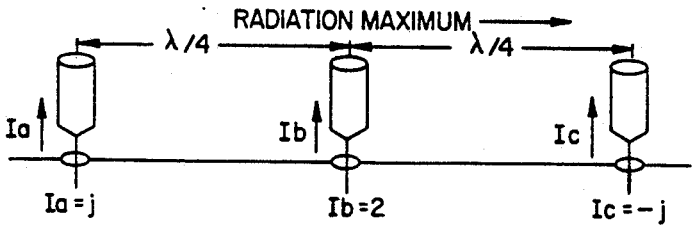
FIG. 5 shows desirable current relationships for an end-fire array.
Figure 6:
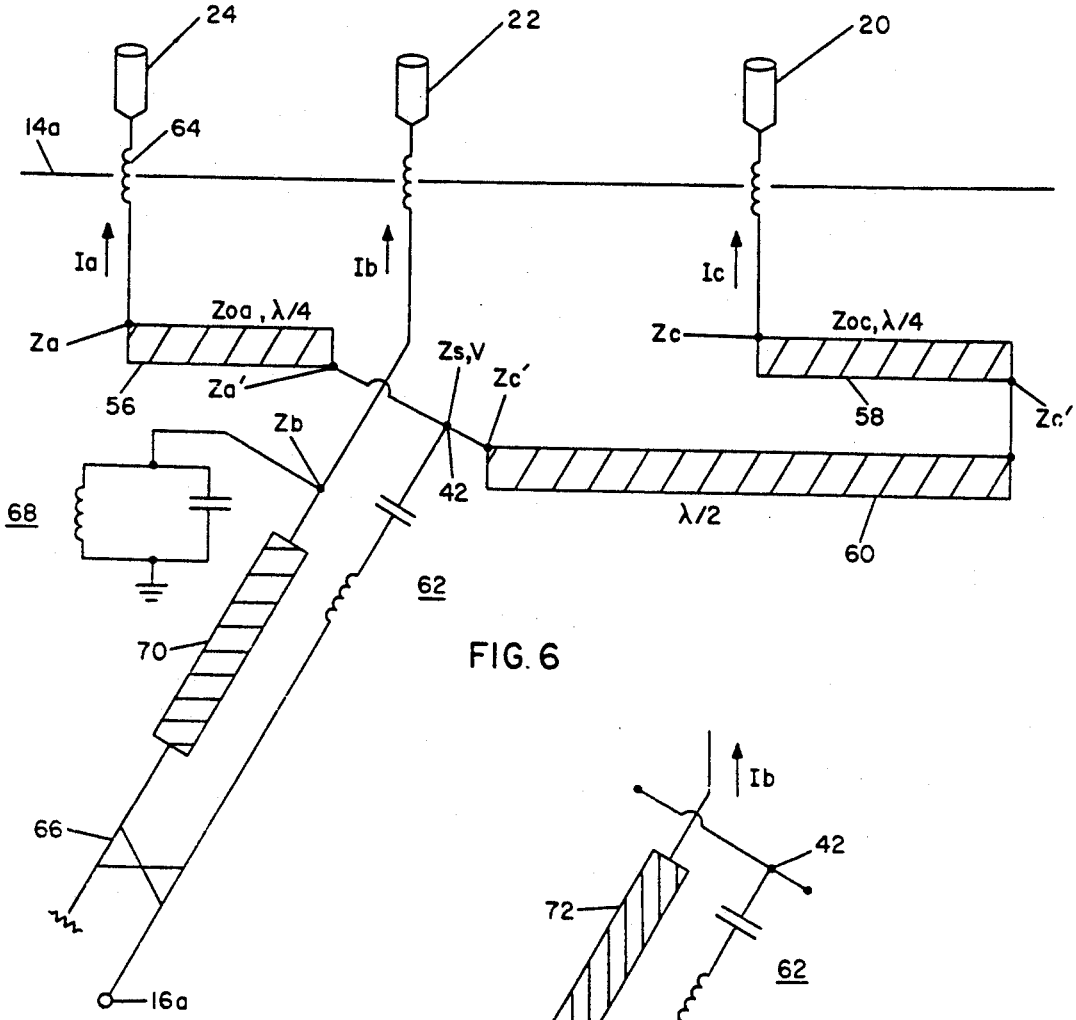
FIG. 6 is a circuit diagram of a three monopole array antenna.

FIG. 5 shows a three monopole array arranged to provide an end-fire pattern and FIG. 6 shows such an array antenna with an excitation system in accordance with the invention. A good end-fire pattern is obtainable from the FIG. 5 array if the elements have the spacings and the phase and amplitude of currents shown. FIG. 6 shows an antenna with an excitation system effective to provide "forced excitation" to cause signal component currents in the antenna elements to have such a predetermined relationship of phase and amplitude, substantially independently of intercoupling affecting the antenna elements, with double tuning to provide for operation over a significant range of frequencies. "Forced excitation" is defined as an excitation arrangement which forces or predetermines the currents in the elements of an array antenna so as to result in currents of desired relative magnitude and phase, substantially independently of mutual and other coupling and impedance effects.

In FIG. 6 there are included first, second and third antenna elements, shown as short monopoles 20, 22 and 24 mounted through and above a conductive ground plane 14a. The FIG. 6 array antenna includes first excitation means comprising quarter wave transformer 56 coupled to third monopole 24, and quarter wave transformer 58 and half wave transmission line 60 coupled to first monopole 20. Transformer 56 and line 60 are also shown coupled to common voltage point 42, as is tuning means 62 which is also coupled to signal input and output terminal 16a. Tuning means 62 is a series resonant LC circuit arranged for double tuning the impedance of rear and forward monopoles 24 and 20. Each of the monopoles is shown as having a series inductance at its base, such as indicator 64 at element 24, for tuning out the capacitive impedances of the short monopole element at one frequency near midband. This narrow band tuning is augmented by the double tuning means 62 to provide substantially increased bandwidth. The FIG. 6 antenna also includes second excitation means comprising a directional coupler 66, for coupling signals of predetermined relative amplitude to the second monopole 22, and second tuning means 68. As shown, coupler 66 is coupled to terminal 16a and is effective to transfer a portion of a signal input to the antenna to monopole 22 by way of transmission line section 70. Second tuning means 68 is a parallel resonant LC circuit arranged for double tuning the impedance of second monopole 22, and the length of line 70 is chosen so that signals reaching monopole 22 have the desired relative phase as compared to signals at monopoles 20 and 24.

In operation of the FIG. 6 array antenna, the two quarter wave transformers 56 and 58 force the currents Ia and Ic in the third and first monopoles 24 and 20 to be dependent substantially wholly on the voltage at the common voltage point 42. Thus, Ia and Ic are forced to be in the ratio $Ia/Ic = Zoc/Zoa$, where the latter are the respective transmission line impedances of the transformers 58 and 56. The half wave line 60 introduces a reversal in the polarity of Ic at element 20, relative to Ia at element 24. The ratio of Ib to the Ia and Ic currents is not forced and cannot be forced because of the 90° phase difference needed to obtain the desired signal component relationship of $Ia = j$, $Ib = 2$ and $Ic = -j$, as shown in FIG. 5. However, if $Ia = -Ic$ then the second monopole 22 will effectively be at a null point midway between the equal and opposite signals at elements 20 and 24 and no net signal from those monopoles will be coupled to element 22. In this case there is no need for Ib to element 22 to be forced.

As a specific example, computations of impedance were made using a commercial computer program for three monopoles arranged as in FIG. 5 with currents as in FIG. 5. The computations were made at 1,030 MHz, 1,060 MHz, and 1,090 MHz for an array of three identical monopoles one inch high, 1.6 inches wide at the top and with center-to-center spacing of 2.78 inches. Computed results were as follows:

| | 1030 | 1060 | 1090 |
|---|---|---|---|
| Za | −0.89−j61.8 | −0.6−j57.0 | −0.31−j52.7 |
| Zb | 6.0−j57.4 | 6.4−j52.6 | 6.8−j48.1 |
| Zc | 14.7−j47.5 | 15.7−j42.4 | 16.7−j37.8 |
| Za + Zc | 13.8−J109.3 | 15.1−J99.4 | 16.4−j90.5 |

With reference to FIG. 6:

$$Ys = Ya' + Yc'$$

For quarter wave transformers:

$$Ya' = Za/Zoa^2 \qquad Yc' = Zc/Zoc^2$$

Let Zoa=kZoc $$\begin{aligned} Zs &= Zoa^2/(Za + k^2Zc) \\ &= Zo^2/(Za + Zc), \text{ if } k = 1 \end{aligned}$$

where $Zoa = Zoc = Zo$

From the table above, with the reactance tuned out at midband by the series inductances such as 64, Za+Zc is approximately equal to 15 ohms.

From the last equation, and assuming we want Zs to be 50 ohms:

$$\begin{aligned} Zo^2 &= Zs\,(Za + Zc) \\ &= 50\,(15) \\ Zo &= 27.4 \text{ ohms} \end{aligned}$$

Note that in FIG. 6, the quarterwave transformers and transmission line sections are shown as being sections of microstrip transmission line that are dimensioned to provide the desired characteristic impedances. Thus, lines 60 and 70 in this example would be 50 ohm line sections and transformers 56 and 58 would be 27.4 ohm sections one quarter wavelength long at a frequency of 1,060 MHz. Reactive tuning circuits 62 and 68 are used to optimize antenna performance at 1,030 MHz and 1,090 MHz (i.e., are adjusted to double tune the respective antenna elements at those frequencies). Note also that, because of mutual coupling, Za has negative resistance, making it very difficult to precisely and efficiently provide the desired Ia over a frequency band, in the absence of the invention. However, (Za+Zc) has a substantial positive resistance which can be efficiently double tuned while providing the desired Ia and Ic values, in accordance with the invention. Achievement of an array antenna pattern with a high front-to-back ratio and strong radiation over a wide angle in the front sector requires precise control of the relative currents in the array elements, as made possible by the present invention.

Figure 7:
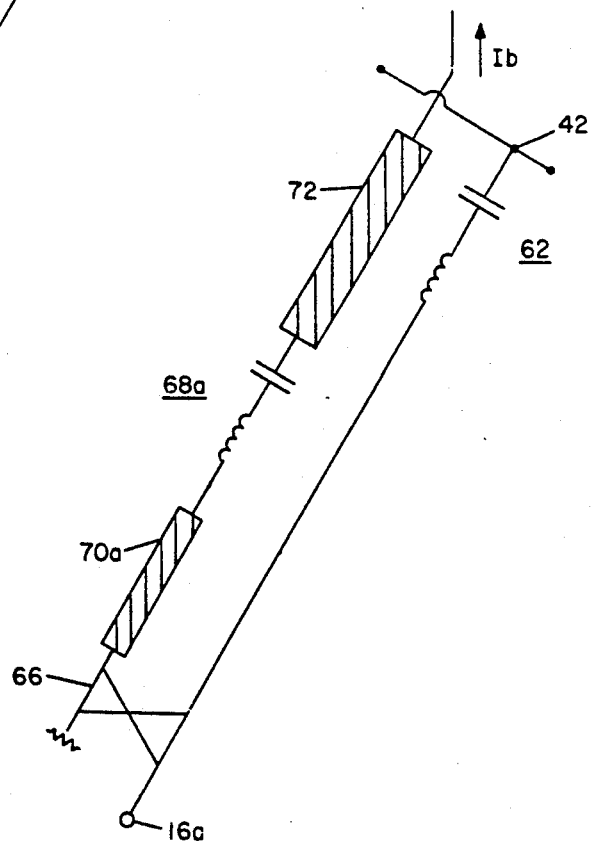
FIGS. 7 and 8 are circuit diagrams of alternative forms of the FIG. 6 antenna.
Figure 8:
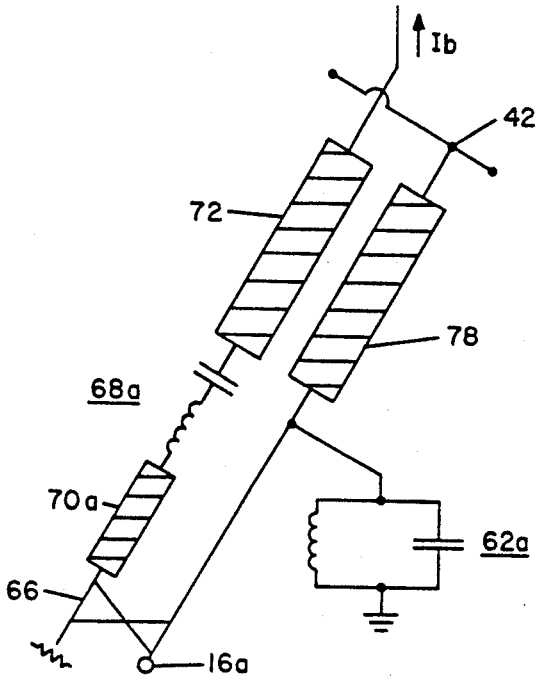

Referring now to FIGS. 7 and 8, there are shown alternative excitation circuits for array antennas similar to the FIG. 6 antenna. For the FIGS. 7 and 8 antennas, the monopoles and the excitation means between point 42 and the monopoles 20 and 24 are the same as shown in FIG. 6. In FIG. 7 the excitation means for the second element includes a quarter wave transformer 72 similar to transformers 56 and 58 in FIG. 6. Zo of 72 should be different than Zo of 56 and 58. In the FIG. 7 antenna, the tuning function can be provided by a series resonant LC circuit 68*a* and the length of line 70*a* can be reduced, otherwise operation corresponds to operation of the FIG. 6 antenna. In FIG. 8, the excitation means for the forward and rear elements includes a quarter wave transformer 78 similar to transformer 72 included in the second element excitation means in FIG. 7. In the FIG. 8 arrangement, the parallel resonant LC circuit 62*a* provides the tuning function, and operation again corresponds to operation of the FIG. 6 antenna. The LC circuits, such as 68*a* and 62*a*, may use discrete reactance components or appropriate lengths of transmission line, as will be apparent to those skilled in the art.

Figure 9:
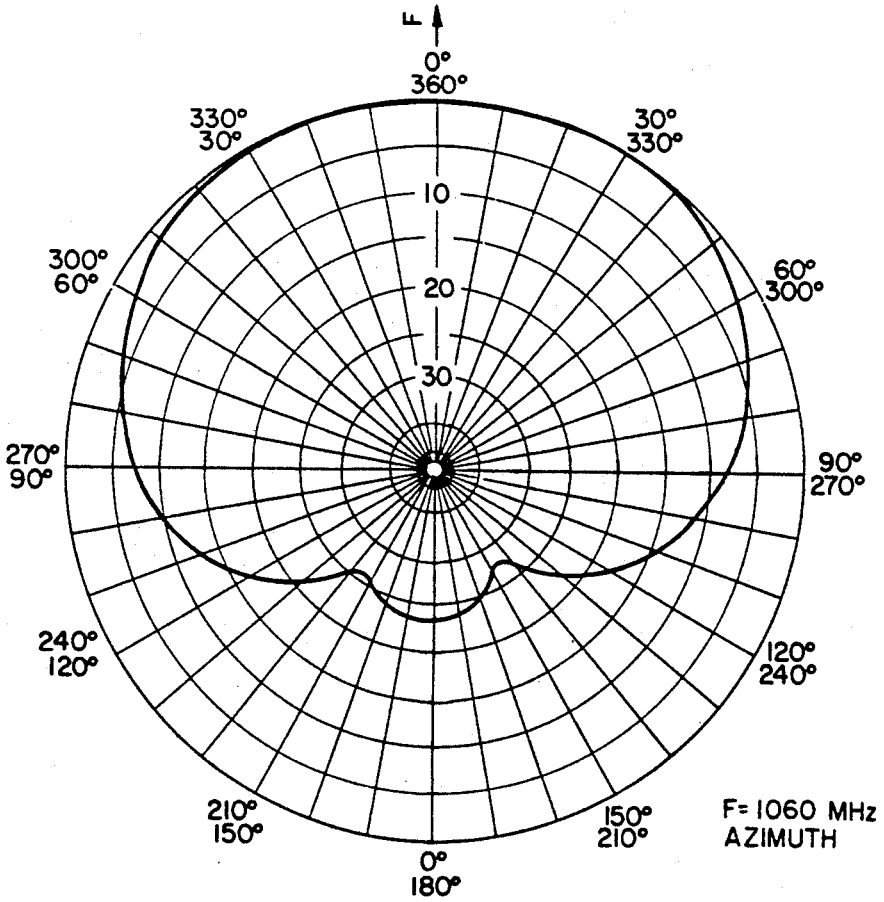
FIG. 9 is an antenna pattern for operation of an array antenna of the type shown in FIG. 6.

FIG. 9 is an actual measured azimuth antenna pattern at 1,060 MHz for an array antenna with three monopoles resembling those shown in FIG. 2*c*, with a monopole width of 2 inches, spacing of 2.78 inches and height of 0.91 inches, after adjustments for the excitation circuits intended to optimize the results achieved. Note that the front-to-back ratio is greater than 20 dB, and the pattern remains strong over a wide angle in the front sector. Similar results were obtained at 1030 and 1090 MHz. It is believed that the antenna performance reflected in this data is clearly beyond the performance of any known prior art monopole array antenna of comparable dimensions.

Figure 10A:
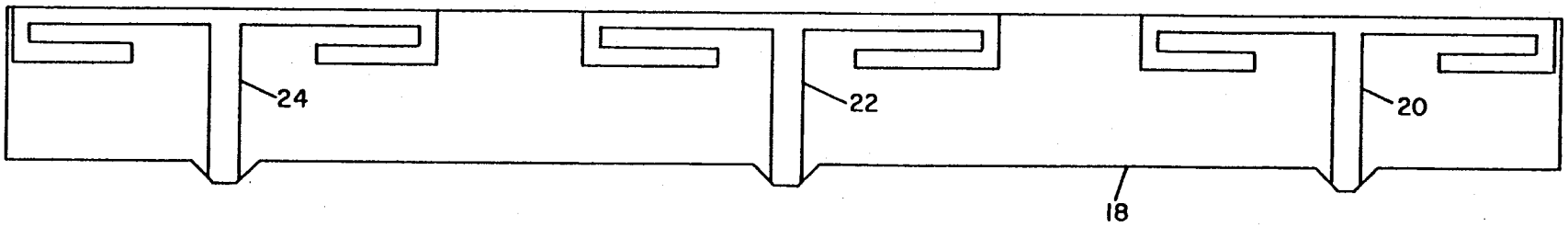
FIGS. 10*a* and 10*b* illustrate component parts of an array antenna of the type shown in FIG. 6.
Figure 10B:
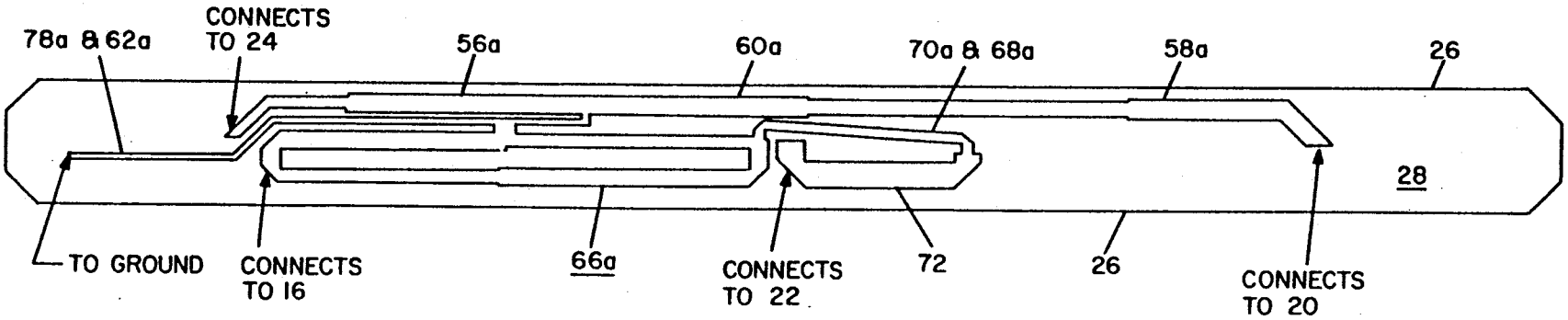

FIGS. 10*a* and 10*b* show printed circuit cards 18 and 26 designed for this antenna. On card 18, three monopoles 20, 22 and 24 as shown, were formed by etching a copper layer on dielectric card 18 to leave conductive patterns in the form of the monopoles. The pattern shown on surface 28 of the card 26 was similarly formed. The actual pattern shown on card 26 represents microstrip transmission line sections of various lengths and characteristic impedances, together with interconnecting points and sections, designed to implement the antenna in a physically simple form providing ease of production and assembly, consistent electrical characteristics, inherently high reliability and good durability under shock and vibration conditions common in high-performance aircraft applications. While reference numerals corresponding to the FIG. 6 antenna, with substitution of the alternative excitation circuit of FIG. 8, have been included in FIG. 10, it will be understood that reducing the antenna to a microstrip layout, and refining that configuration for maximum performance, results in a final physical embodiment of the invention in this example in which there is a degree of inherent masking of the identification of discrete components. Thus, while portions of the conductive pattern on card 26 in FIG. 10 have been given identifying numerals, it may be difficult or not possible to specifically identify the metes and bounds of a particular component so as to separate it from the remainder of the circuit.

Figure 11:
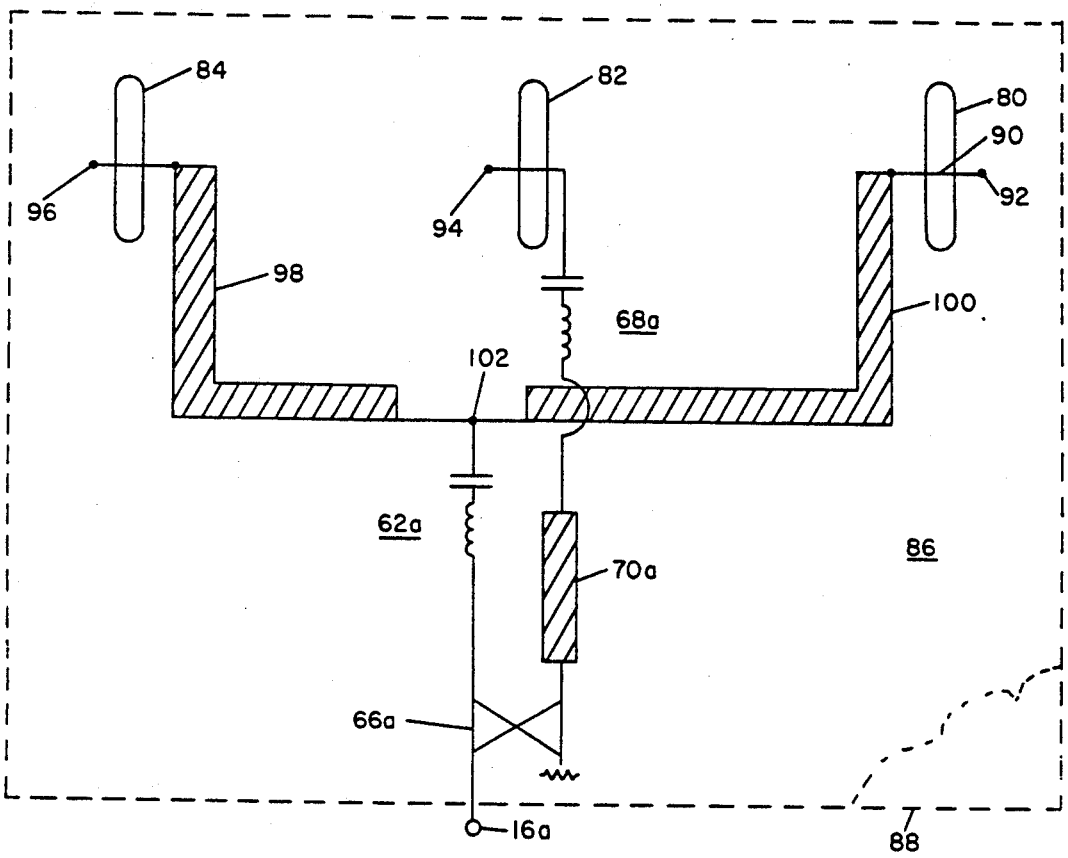
FIG. 11 is a circuit diagram of a three slot array antenna.

FIG. 11 shows an array antenna in accordance with the invention wherein the individual radiating elements are slots. A three element slot array, as shown, is subject to disruptive mutual coupling effects similar to those previously discussed with reference to monopoles. Slots 80, 82 and 84 in FIG. 11 may simply be openings in a conductive covering 86 on the forward side of a dielectric sheet 88. Conductive covering 86 and dielectric sheet 88 are both shown as being transparent for ease of illustration in order to make visible the other elements which may be disposed on the backside of the dielectric sheet, as shown.

Each of the slots or windows 80, 82 and 84 in the conductive member 86 may typically be a half wavelength long or, alternatively, may be shorter with shunt capacitances inserted across the center of the slot at one frequency near midband. The slots in the array are spaced by a quarter wavelength, with a width equal to a fraction of the spacing. Dimensions can be selected for particular applications using known design techniques. As shown, each slot is excited by a conductor passing across the slot on the back of the dielectric sheet, as shown at 90, and passing forward or upward through the dielectric 88 to terminate at a point 92 in electrical contact with the conductive covering 86 at the side of slot 80. As shown, slot 80 has an excitation conductor termination point 92 at its right side and will be excited with a phase or a polarity of excitation opposite to that of slot 84, which has such termination point at 96 at its left side. Although not shown, each slot is typically backed by a metallic box or conductive cavity to allow radiation only in the forward or outward direction from each slot. It will be appreciated that an antenna in the form of an array of slots is particularly advantageous for implementation in a configuration flush with the surface of an aircraft. The present invention is readily adaptable to such applications.

The FIG. 11 antenna includes first excitation means shown as half-wave transmission lines 98 and 100 coupling the third and first elements 84 and 80 to the terminal means 16*a* via common voltage point 102. Reactive means 62*a* is shown coupled between point 102 and terminal 16*a* for providing double tuning in a desired frequency range. Second excitation means, shown as directional coupler 66*a*, is coupled between terminal 16*a* and second element 82, via transmission line section 70*a* and reactive means shown as LC circuit 68*a*. Operation of the FIG. 11 antenna is similar to the FIG. 6 antenna. Characteristics of slots permit use of transmission line sections 98 and 100 without provision for quarter wave transformers in providing a common voltage point enabling forcing of the voltages across the slots to have the desired magnitude and phase, substantially independently of mutual and other coupling and impedance effects. With slot radiators, the significant signal component that determines the radiation pattern of an array is the slot voltage, in contrast to monopole or dipole radiators which have their currents as the significant signal components. Desired slot voltages for a good end-fire pattern with the FIG. 11 array have phase and amplitude values similar to the monopole currents shown in FIG. 5. The FIG. 11 system can provide this forced excitation together with double tuning for increased bandwidth.

Figure 12:
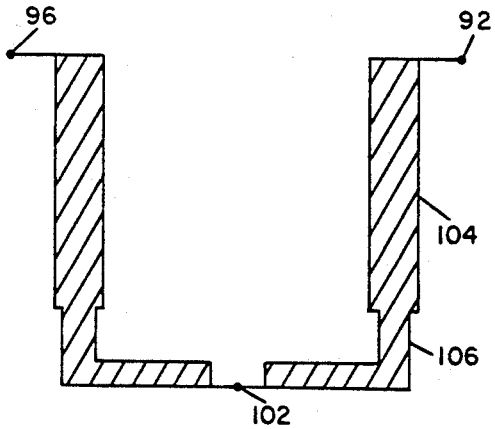
FIGS. 12 and 13 are circuit diagrams of alternative forms of the FIG. 11 antenna.
Figure 13:
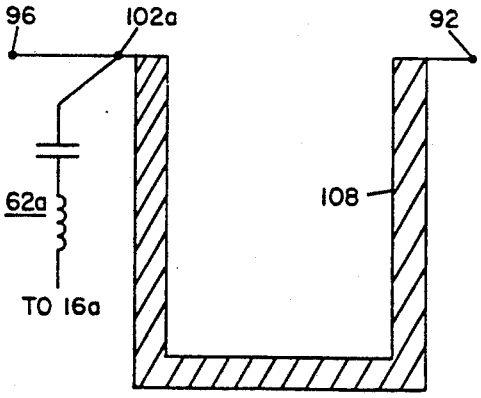

FIGS. 12 and 13 show alternative embodiments regarding the means connecting points 96 and 92 to point 102 in antennas which otherwise correspond to FIG. 11. In FIG. 12 the half wave transmission lines 98 and 100 have each been replaced be a series combination of two quarter wave transformers, such as transformers 104 and 106 shown as replacing line 100 between points 92 and 102. This arrangement provides wideband transformation of the slot conductance to a convenient value such as 50 ohms at point 102. In FIG. 13, half wave lines 98 and 100 have been replaced by a single full wavelength transmission line segment 108 connecting points 96 and 92, and reactive tuning circuit 62*a* connects to a point 102*a* in the vicinity of point 96. Variations such as shown in FIG. 13 can provide flexibility in particular applications.

The preceding embodiments are particularly shown and described in the context of an array of three radiating elements, however, it will be apparent that in some applications it may be desirable to provide one or more array antennas, each of which includes four or more radiating elements with forced excitation in accordance with the invention.

Figure 14:
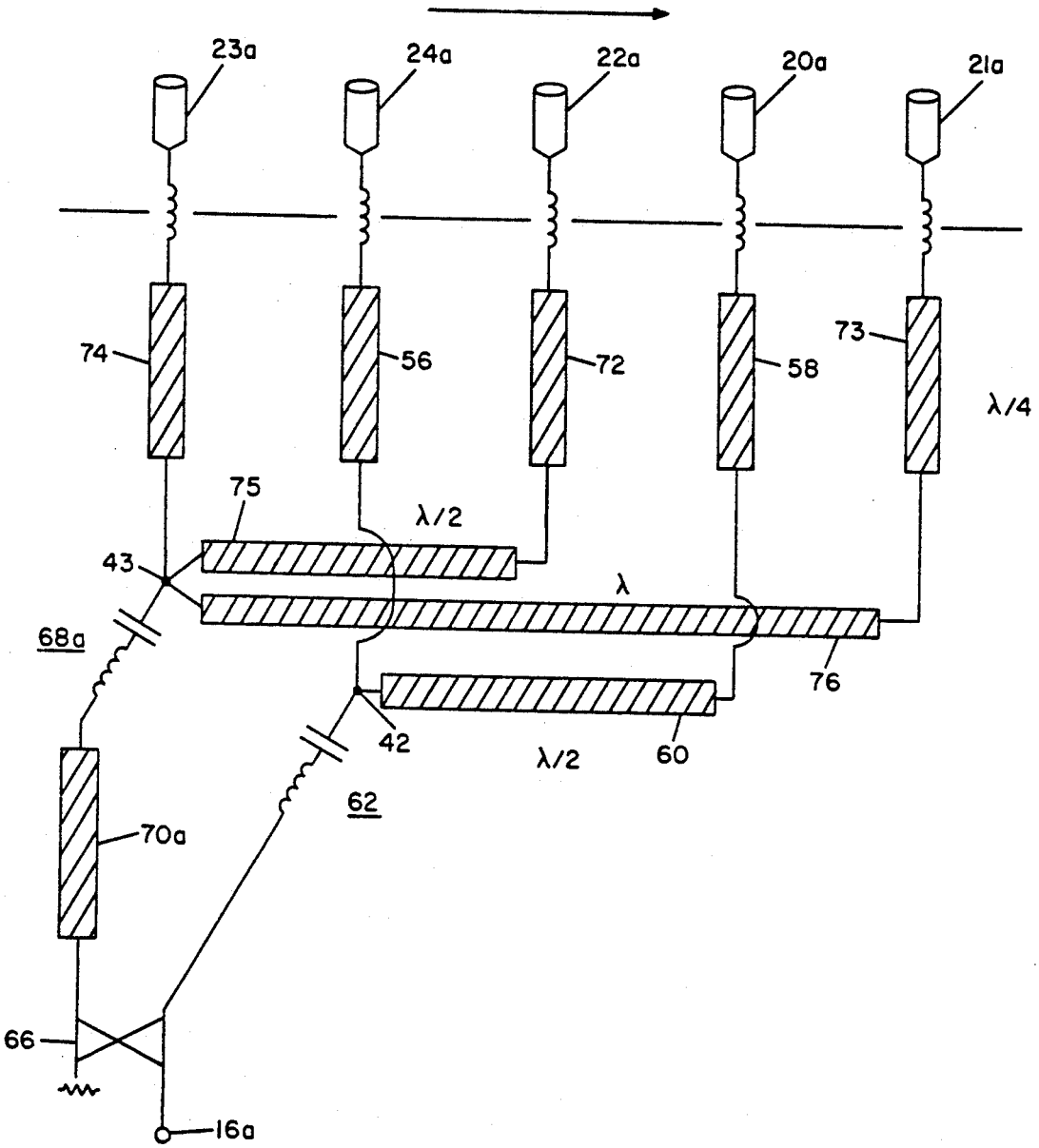
FIG. 14 is a circuit diagram of a five monopole array antenna.

Referring now to FIG. 14, there is illustrated an embodiment of the invention comprising a linear array of five antenna elements shown as monopoles 20*a* through 24*a*. As shown, the first, second and third elements 20*a*, 22*a* and 24*a* (corresponding to the first, second and third elements of FIG. 6) have been supplemented by a leading element 21*a*, ahead of element 20*a*, and a trailing element 23*a*, following element 24*a*. In considering the FIG. 14 antenna, it is important to note that the arrangement and functioning of elements 20*a*, 22*a* and 24*a* are as described with reference to a three element array, the three element array of first, second and third elements being a basic subset used in antennas utilizing the invention.

In FIG. 14, elements 20*a*, 22*a* and 24*a* correspond to elements 20, 22 and 24 of FIG. 6. The FIG. 14 excitation system corresponds to the alternative excitation system of FIG. 9, with modification for excitation of the additional elements 21*a* and 23*a*. As shown in FIG. 14, a first group of non-adjacent antenna elements 20*a* and 24*a* are coupled to first excitation means shown as signal transmission means including halfwave transmission line 60 and quarterwave transformers 56 and 58. The remaining elements, middle element 22*a*, leading element 21*a* and trailing element 23*a*, are coupled to second excitation means shown as directional coupler 66, transmission line section 70*a*, quarterwave transformers 72, 73 and 74, and half and full wavelength transmission lines 75 and 76, respectively. Signals are coupled by the excitation means to elements 20*a* and 24*a* by way of common voltage point 42 and to elements 21*a*, 22*a* and 23*a* by way of a second common voltage point 43, permitting forced excitation.

If there were only four elements, the element 21*a*, transformer 73 and line 76 could be eliminated. For any number of elements there are actually two voltage points in accordance with the invention, to which signals are fed. For three elements, one of these voltage points is a common voltage point for two elements, permitting predetermined magnitudes and phases of current to be provided. For more than three elements the invention makes available two common voltage points, 42 and 43 for example, each connecting to two or more elements.

DESCRIPTION OF FIGS. 15–22

Figure 15:
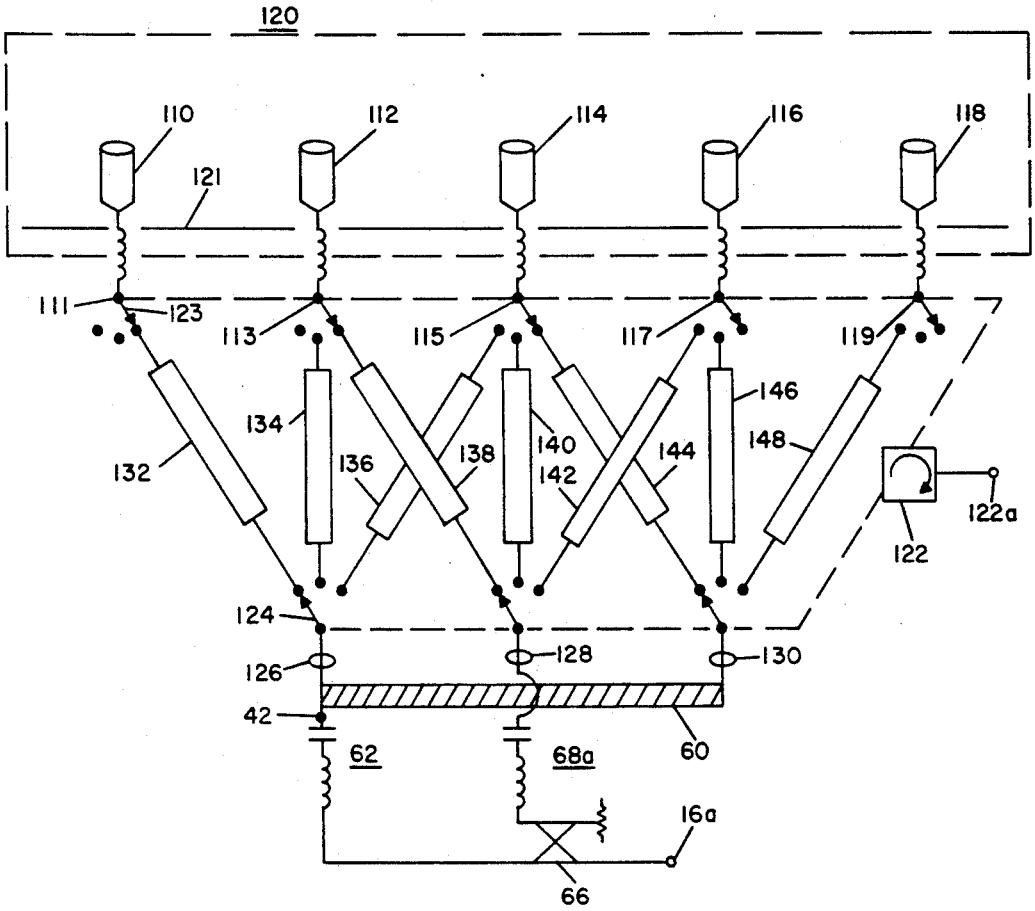
FIG. 15 is a circuit diagram of a five monopole switchable array antenna in accordance with the invention.

Referring now to FIG. 15, there is shown a switchable array antenna in accordance with the present invention. FIG. 15 includes five antenna elements, shown as monopoles 110, 112, 114, 116 and 118, supported above a ground plane 121 in a linear array and arranged for excitation in subsets of three elements. Shifting means, shown as switch 122, selectively connects the subsets of elements (i.e., elements 110, 112, and 114, elements 112, 114 and 116, or elements 114, 116 and 118) to excitation means for coupling signal components from and to the selected elements during reception and transmission of radiated signals. Thus, during transmission, shifting means 122, which may comprise mechanical or electronic individual switching means such as switches 123 and 124, selectively shift the coupling of signal components appearing at terminals 126, 128 and 130 to different first, second and third element subsets of the antenna elements 110, 112, 114, 116 and 118. For example, with shifting means 122 in the position illustrated in FIG. 15, forward, middle and rear signal components for achieving an end-fire antenna pattern directed toward the right are respectively coupled to a first element 114, a second element 112 and a third element 110. As will be described further, when the forward, middle and rear signal components are shifted to a different three element subset, such as a first element 118, a second element 116, and a third element 114, the effective element radiation center of the array is shifted forward from the vicinity of element 112 to the vicinity of element 116.

As shown in FIG. 15, the switchable array antenna also includes terminal means, first excitation means, second excitation means and tuning means substantially as described above with reference to FIGS. 6 and 7. The terminal means is illustrated as terminal 16*a* for coupling signals to and from the antenna. First excitation means is shown as including a half-wavelength transmission line 60 for coupling a signal component to terminal 130 with a phase reversal, as compared to the signal component coupled to terminal 126, and a set of two quarter wave transformers for coupling such signal components to first and third elements, respectively, of a selected three element subset of the five antenna elements illustrated. With switching means 122 in the position shown, it will be seen that the first excitation means utilizes a quarter wave transformer 144 coupling to element 114 and transformer 132 coupling to element 110. Second excitation means is shown as including directional coupler 66 for coupling a signal component of predetermined amplitude to terminal 128 and a quarter wave transformer 138 coupling to element 112, which is the second element of the selected 114, 112, 110 element subset in this example. Tuning means, shown as series LC circuit 68*a* coupled to the first excitation means via common voltage point 42 and series LC circuit 62 coupled to the second excitation means, provide double tuning of the antenna elements.

The structure and operation generally and as to individual elements of the excitation and tuning means are covered more specifically in the description of FIGS. 6 and 7 wherein corresponding reference numerals refer to similar components. It will be seen, however that the functions of three quarterwave transformers (56, 58 and 72 in FIG. 6 with the FIG. 7 modification) are provided in FIG. 15 by quarterwave transformers 132, 134, 136, 138, 140, 142, 144, 146 and 148, which are utilized in sets of three dependent on the operation of switch 122. Alternatively, three quarterwave transformers can be inserted at points 126, 128 and 130, respectively, and the nine quarterwave transformers in FIG. 15 replaced by nine halfwave transmission lines.

The operation of the FIG. 15 antenna is basically as described with reference to FIG. 6. By enabling the phase and amplitude of the respective currents in first, second and third elements, such as elements 114, 112 and 110, to be forced to have predetermined values, an end-fire or other desired antenna pattern is achieved. The FIG. 15 antenna differs in permitting the radiation center of the array to be shifted to be in the vicinity of element 112, 114 or 116, depending on whether excitation is applied to a first, second and third element subset 114, 112, 110 or 116, 114, 112 or 118, 116, 114 by action of the shifting means shown as switch 122.

With reference to FIG. 2, it will be understood that the FIG. 15 antenna can be constructed as in FIG. 2 with a protective cover and base member similar to elements 12 and 14 in FIG. 2. Also, antennas in accordance with FIG. 15 can be arranged in a laterally spaced array supported on a surface such as the fuselage of an aircraft, as shown in FIG. 3.

Figure 16:
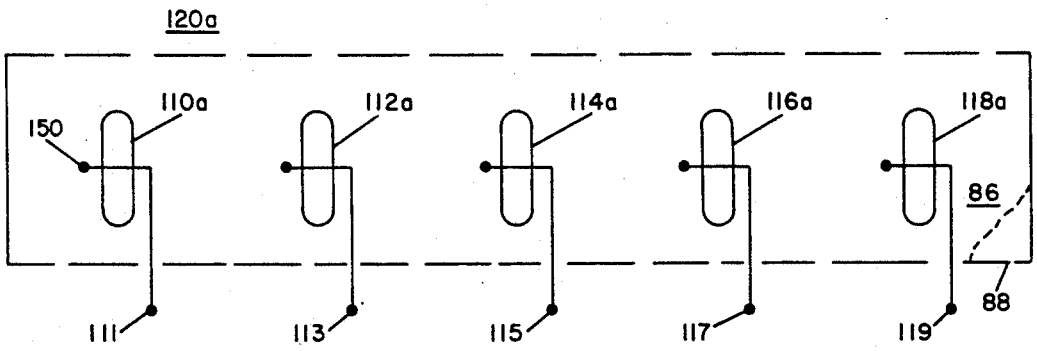
FIG. 16 shows an alternative form of the FIG. 15 antenna utilizing slots.

In FIG. 15, the radiating element array 120 is shown as comprising five monopoles coupled to points 111, 113, 115, 117 and 119. FIG. 16 shows an alternative form of radiating element array 120*a* which can be substituted in a modified FIG. 15. As shown, array 120*a* comprises five slots 110*a*, 112*a*, 114*a*, 116*a* and 118*a* illustrated as elongated openings in a conductive layer or surface 86 coupled to an insulative layer or member 88. As discussed with reference to FIG. 11, members 86 and 88 are shown as being transparent to show the connection from point 111, in an insulated relationship across slot 110*a* behind layer 88, and passing through layer 88 to terminate in contact with layer 86 on the left side of the slot at point 150. Whereas in FIG. 11 a relative phase reversal was introduced for the signal component fed to slot 80 by virtue of the feed conductor crossing to a contact point 92 on the right side of slot 80, in FIG. 16 all contact points are to the left side of the respective slots. For the FIG. 16 antenna, a phase reversal is introduced by the half wave line section 60 shown in FIG. 15, so that the FIG. 15 and 16 antennas can both use a similar excitation system such as shown in FIG. 15. However, with the FIG. 16 antennas, the quarter-wave transformers in FIG. 15 must be replaced by half-wave transmission lines.

Operation of the FIG. 16 alternative form of antenna is basically as described with reference to FIG. 11, with the additional capability of shifting of the effective radiation center dependent upon the selected excitation of first, second and third element subset 114*a*, 112*a*, 110*a*, or subset 116*a*, 114*a*, 112*a*, or subset 118*a*, 116*a* or 114*a*.

Figure 17:
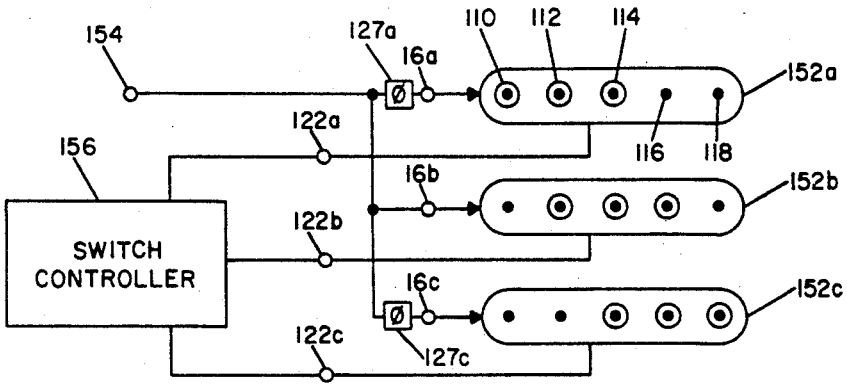
FIG. 17 shows a steerable antenna array system in accordance with the invention.

Referring now to FIG. 17, there is shown a simplified schematic of a steerable antenna array system in accordance with the invention. As illustrated, the array system includes a plurality of switchable array antennas shown as three identical antennas 152*a*, 152*b* and 152*c*, which may be of the type shown in FIG. 15 or 16. The three switchable array antennas are spaced laterally relative to an end-fire radiation direction to the right in the drawing. In FIG. 17, signals supplied to terminal 154 are coupled to the three antenna terminals 16*a*, 16*b*, and 16*c*, corresponding to terminal 16*a* in FIG. 15. As in FIG. 15, in each of antennas 152*a*, 152*b*, 152*c*, signal components will be coupled by the respective excitation means to a selected first, second and third element subset of the five elements 110, 112, 114, 116 and 118, which are represented by dots, such as dot 118. Assuming shifting means 122 of antenna 152*a* to be in the position shown in FIG. 15, the active element subset in antenna 152*a* will be elements 114, 112, and 110, which are circled to indicate the active subset.

In FIG. 17 there is also included azimuth control means shown as switch controller 156 coupled to the respective shifting means (122 in FIG. 15) of each of the antennas via terminals 122*a*, 122*b* and 122*c*. The shifting means 122 of each antenna may be activated to select one of the three different element subsets and controller 152 comprises a control circuit or mechanism for adjusting the shifting means so that the effective radiation center of each antenna is in a selected position.

As indicated by the circled dots in FIG. 17 representing the activated antenna elements, the shifting means are adjusted in this example so that the effective radiation center is in the vicinity of element 112 for antenna 152*a*, in the vicinity of element 114 for antenna 152*b*, and in the vicinity of element 116 for antenna 152*c*. Based on well known concepts of theory and operation of phased array antennas, three FIG. 15 antennas laterally spaced as in FIG. 17 and identically excited in an end-fire mode would produce a beam directed to the right in FIG. 17. However, excitation of the antennas with different centers of radiation as indicated in FIG. 17 would steer the beam to an angle while preserving the straight shape of the fan beam.

Figures 18A, 18B, 18C, 18D, 18E:
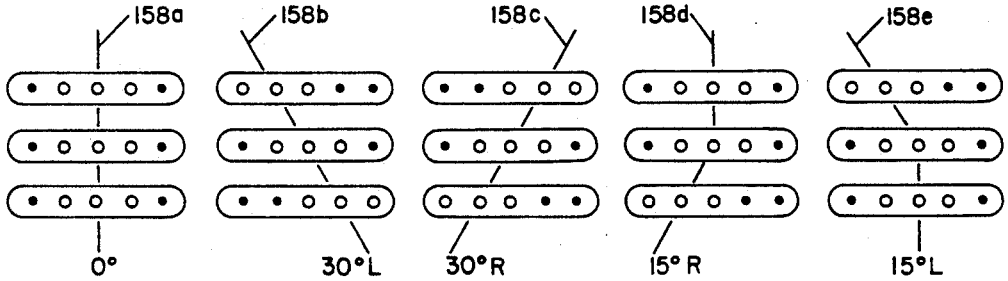
FIGS. 18A–18E show excitation alternatives useful in describing operation of the FIG. 17 antenna system.
Figure 19:
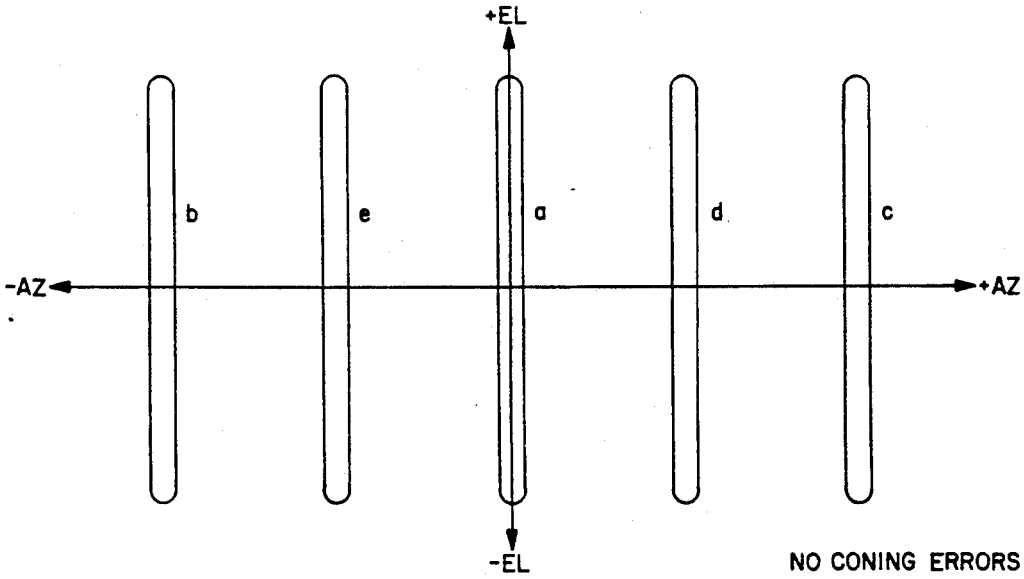
FIG. 19 shows the straight fan beams that are provided by the FIG. 17 antenna system.

This is better illustrated in FIG. 18, which is a simplified representation of three spaced array antennas excited in five different modes. In FIG. 18*a*, the circles identifying the active elements indicate that the three antennas, such as 152*a, b* and *c* in FIG. 17, are identically excited with their centers of radiation along the line 158. Line 158 effectively represents the wavefront for this excitation and would result in a beam direction normal to line 158. In FIG. 18*b* excitation is as indicated in FIG. 17, resulting in a rotated wavefront line producing a normal beam direction angled to the left of the original beam direction by an angle of 30°, for example, dependent on the actual dimensioning of the antennas. FIG. 18*c* indicates a wavefront for a beam angled to the right and FIG. 18*d* shows a segmented wavefront resulting in a beam direction angled to the right less than the FIG. 18*c* beam direction. On a simplified basis, the beam direction in FIG. 18*d* can be considered to be the mean of partial beams normal to the two wavefronts represented. The actual beam direction for excitation as in FIGS. 18*d* and *e* can be calculated or measured based on actual dimensions and characteristics of the antennas to be used, the important point being that relative positioning of the effective radiation centers determines the wavefront and beam position. All of the beams resulting from the excitations shown in FIG. 18 preserve the straight shape of the fan beam. This is shown in FIG. 19.

Figure 1:
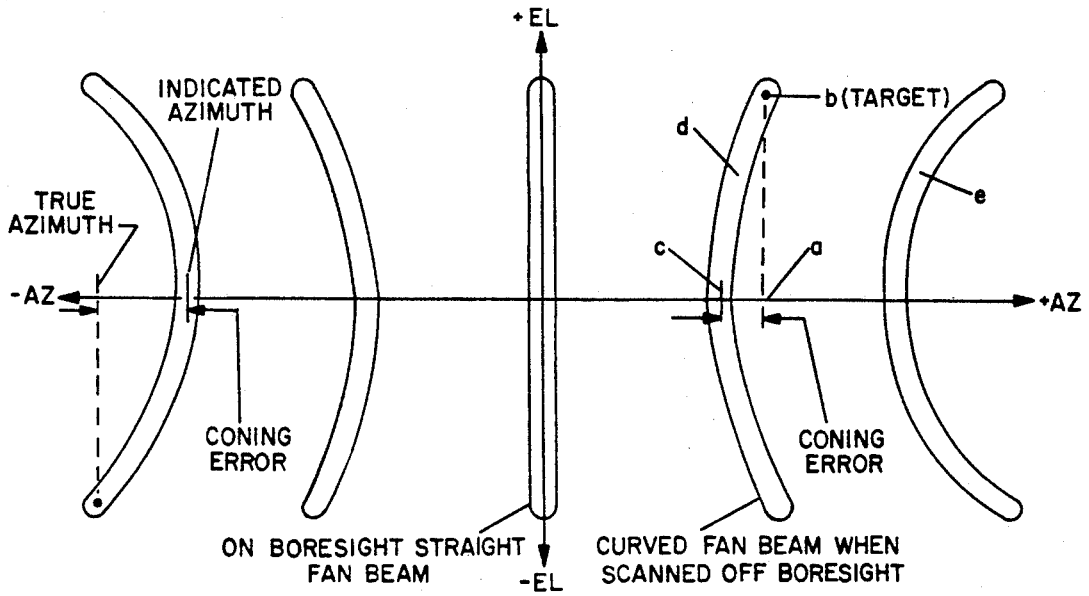
FIG. 1 (PRIOR ART)
FIG. 1 illustrates the effect of scanning a linear array antenna off axis.

FIG. 17 also shows phase shifters 127*a* and 127*b* in channels 16*a* and 16*c*, respectively. These phase shifters can provide two benefits. First, they may be used to reduce the bend in the wavefront of FIG. 18*d* or 18*e* while still preserving the beam direction and the straight shape of the fan beam. Second, they may be used to steer the beam to any azimuth angle between or beyond the five angles shown in FIG. 19. In this case the fan beams become curved, but typically much less curved than the prior art case of FIG. 1.

It should be understood that although three array antennas each containing five antenna elements have been shown in FIGS. 15, 16, 17 and 18, the number of array antennas and antenna elements in each array antenna can be greater. Also the number of active antenna elements in each array antenna can be greater than three.

In operation, a laterally spaced combination of array antennas with effective radiation centers controlled by azimuth control means can have its antenna beam selectively steered. In this way, a target which is off-boresight relative to the antenna system, need not be off-boresight relative to the active elements in the antenna system. With the beam steered toward the target, off-boresight errors associated with coning of the beam are reduced, thereby improving the accuracy of the indicated azimuth bearings of targets at varying altitudes relative to the base aircraft.

Figure 20A:
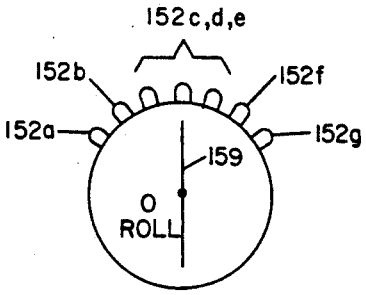
FIGS. 20A–20C illustrate roll conditions in aircraft banking maneuvers.
Figure 20B:
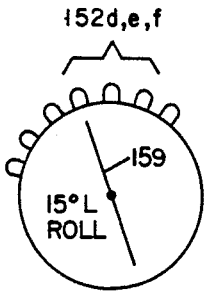
Figure 20C:
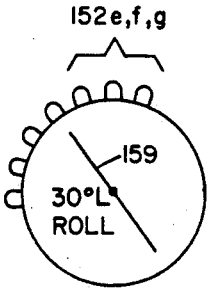

FIG. 20*a* is a simplified representation of a section of aircraft fuselage with seven array antennas 152*a–g* mounted on it (for example, seven FIG. 15 antennas seen in end view). The vertical line 159 in FIG. 20*a* indicates that the vertical axis of the aircraft is not tilted (i.e. the aircraft is not banking). Assume that the three central antennas 152*c, d* and *e* in FIG. 20*a* represent an antenna system with adequate performance in the absence of banking, but that during banking the antenna system is tilted, compromising the performance. As shown in FIGS. 20*b* and *c*, during banking conditions as indicated the invention permits compensation by selection of an operative group of antennas (identified by the bracket) effectively representing a three antenna system (152*d, e* and *f* or 152*e, f* and *g*) which is level at a particular degree of roll caused by banking. In FIGS. 20*b* and 20*c*, selection of the three indicated antennas results in a fan beam which remains vertically oriented relative to the horizon. However, since the vertical axis of the aircraft represented by line 159 has rolled left, the desired beam compensation has actually been accomplished by tilting the fan beam of the antenna system relative to the aircraft on which it is mounted.

Figure 21:
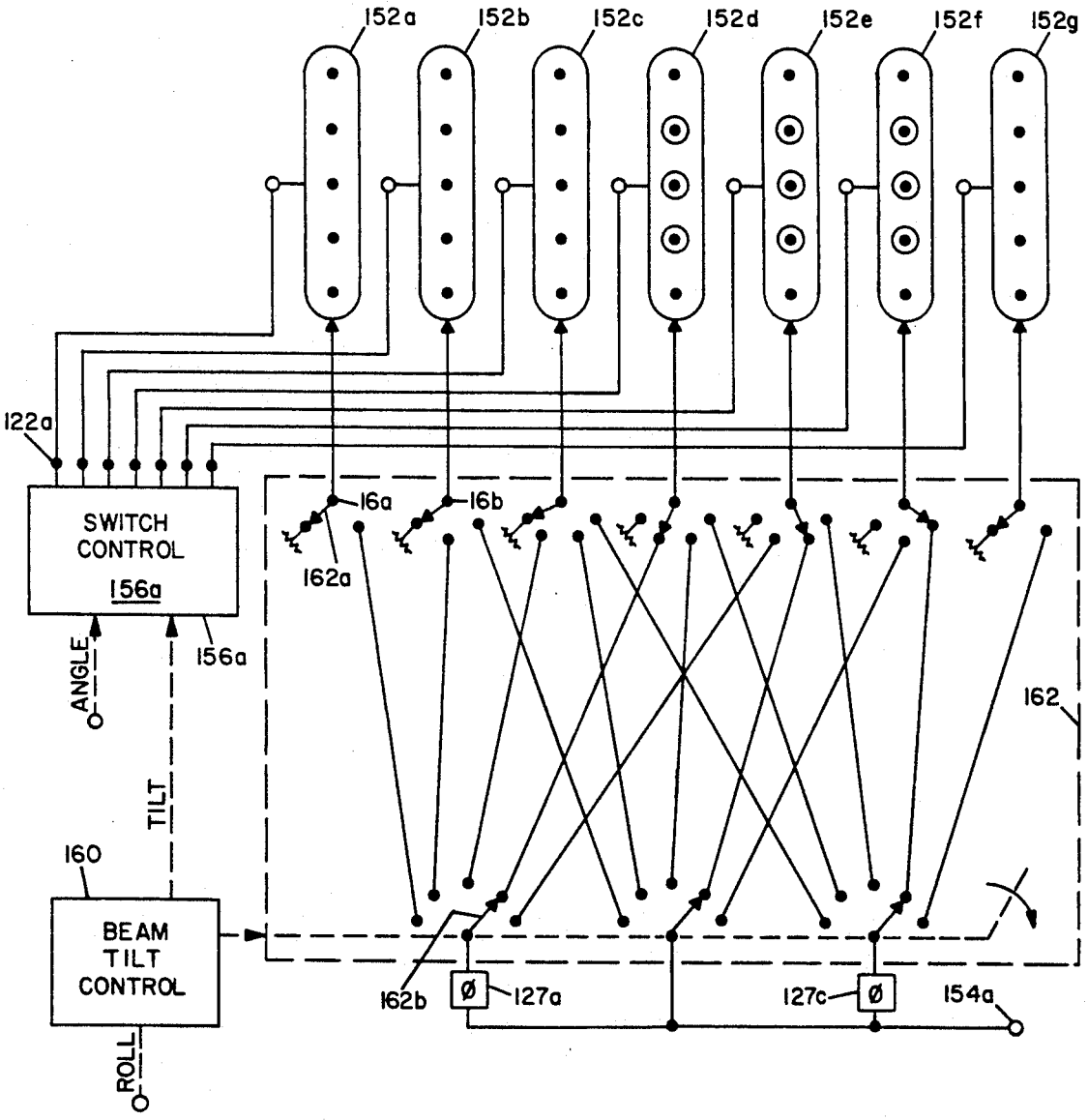
FIG. 21 shows a steerable beam tilt antenna system in accordance with the invention.

Referring now to FIG. 21, there is shown a beam tilt antenna array system able to compensate for aircraft roll and also permitting antenna beam steering while preserving straight fan beams. The antenna will first be described independently of the beam steering capability. As illustrated, the antenna array system includes a plurality of array antennas shown as seven antennas 152*a–g*, which may be the type shown in FIG. 15 or 16. The antennas are arranged to radiate principally in a forward direction (upward, in the drawing) and are spaced laterally, the spacing being such that in the context of an aircraft fuselage the antennas have displacements in a third direction (which is the vertical direction in the FIG. 20*a* view), due to the curvature of the fuselage. Thus, the antennas are basically shown in top view in FIG. 21 and end view in FIG. 20, so that the relative vertical displacements in FIG. 20 are essentially normal to FIG. 21.

The FIG. 21 antenna system also includes beam tilt control means, shown as beam tilt control means 160, for selectively activating signal distribution means 162 for determining which group of antennas is active during particular roll conditions. Information representing the degree of roll may be supplied to means 160 or sensed by any appropriate means therein. In either case, tilt control means 160 controls electronic or other switching means 162, shown as including a series of switches such as 162*a* and 162*b*, to couple signals between terminal 154*a* and selected group of antennas, such as antennas 152*d*, 152*e* and 152*f* as shown in FIG. 21, corresponding to compensation for the roll condition shown in FIG. 20*b*.

In accordance with the invention, a beam tilt antenna may also include beam steering as discussed with reference to FIG. 17. Thus, in FIG. 21, switch control 156*a* functions in the same manner as switch controller 156 in FIG. 17 to selectively control the shifting means of each active antenna. In the case of FIG. 21, information from tilt control means 160, indicative of which three of antennas 152*a–g* are activated at a particular time, is used in means 156*a* to direct shifting means control information to the currently active antennas. In FIGS. 17 and 21 individual radiating elements in an array antenna such as 152*a*, are indicated by dots and active elements by circles for ease of illustration and explanation. The actual elements may be monopoles, slots, etc. as shown and described in greater detail with reference to the other drawings, such as FIGS. 6, 11, 15 and 16, and the various alternatives already covered. Phase shifters 127*a* and 127*b* for additional azimuth beam control are now located below switching means 162.

Figure 22:
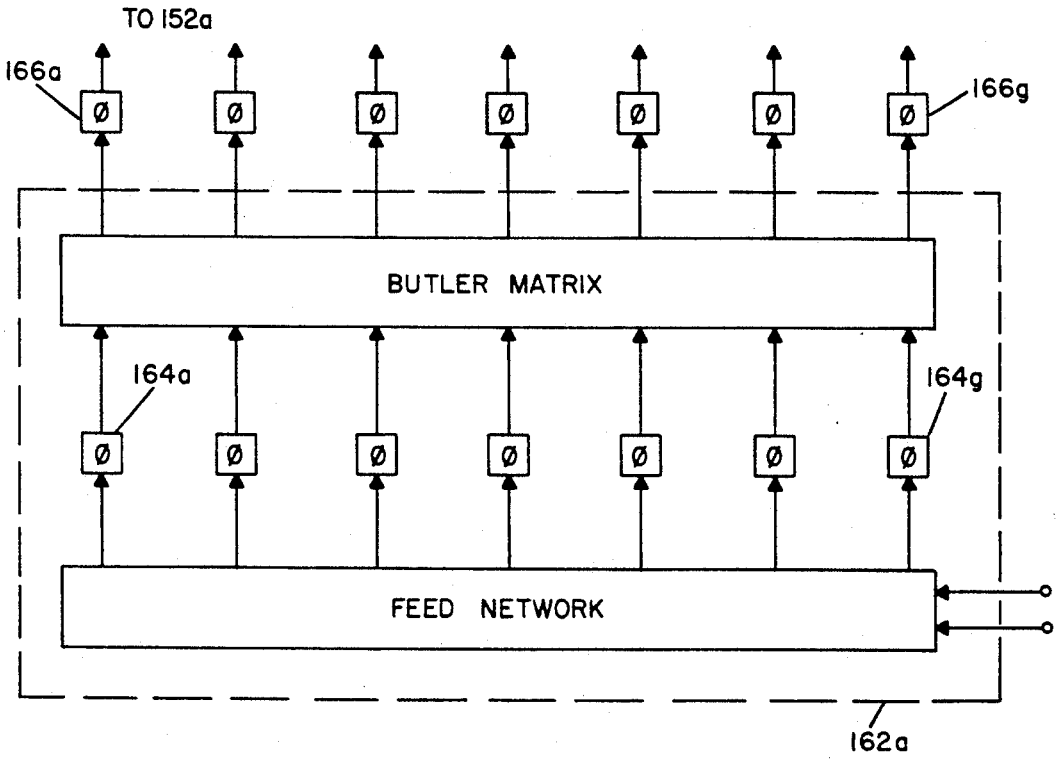
FIG. 22 shows an alternative form of signal distribution network usable with the FIG. 21 antenna system.

In operation of the FIG. 21 antenna, the antenna fan beam is tilted to the right as the aircraft rolls left, and vice versa, to provide a range of compensation as the fan beam would otherwise deviate from its normal reference or vertical orientation. At the same time, the antenna beam may be steered as described with reference to FIGS. 17 and 18, and the beam steering and tilting can be accomplished independently of each other. FIG. 22 is included to indicate that, where desired, alternative forms of signal feed arrangements known in the prior art may be substituted for the switching approach utilized, in place of signal distribution means 162 as shown in FIG. 21. The phase shifters 164*a*–164*g* in combination with the Butler Matrix and feed network smoothly shift the active portions of the array to compensate for aircraft roll. The phase shifters 166*a*–166*g* provide the additional azimuth beam control.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A switchable array antenna, having a plurality of antenna elements arranged for excitation in subsets of at least three elements, comprising:

terminal means for coupling available signals;

a plurality of antenna elements comprising a linear array of at least four said elements arranged for use in subsets, each subset having first, second and third antenna elements and each subset consisting of fewer than said plurality of antenna elements;

first excitation means, coupled to said terminal means, comprising signal transmission means for coupling a first portion of said available signals from said terminal means to provide forward and rear element signal components of predetermined relative phase and amplitude to first and third elements of a subset by way of a point of common voltage included in said first excitation means;

second excitation means, coupled to said terminal means, comprising means for coupling the complementary portion of said available signals from said terminal means to the second element of said subset to provide a middle element signal component of predetermined phase and amplitude relative to said signal components coupled to said first and third elements, said complementary portion and said first portion of said available signals being coupled to said elements of said subset without coupling of said available signals to any antenna element other than said elements of said subset and without intercoupling of said complementary and first portions in a multiport beam forming matrix;

tuning means, included in said first excitation means and coupled to said point of common voltage, for providing impedance matching for said first and third elements in a desired frequency range; and shifting means for selectively coupling said first and second excitation means to different subsets of said elements so that said forward, middle and rear signal components can be respectively shifted to first, second and third antenna elements of different subsets, each of said subsets consisting of fewer than said plurality of elements;

whereby the effective radiation center of said linear array is selectively shifted along the linear array by activation of said shifting means.

2. A switchable array antenna as in claim 1, in which said plurality of antenna elements consists of five antenna elements arranged for selective excitation so that the forward, middle and rear signal components may be selectively coupled so that the first, second and third elements of a subset consist of any three adjacent elements of the linear array of five elements.

3. A switchable array antenna as in claim 1 or 2, in which said antenna elements are monopoles.

4. A switchable array antenna as in claim 1, in which said antenna elements are monopoles and said first excitation means comprises two quarter wavelength transformers for coupling between said common voltage point and said first and third elements, respectively, said wavelength corresponding to approximately the average design frequency of said antenna.

5. A switchable array antenna as in claim 4, in which said second excitation means comprises a directional coupler.

6. A switchable array antenna as in claim 5, in which said first excitation means additionally comprises half wavelength transmission line means, for coupling signals between said first element and said common voltage point with a reversal in phase relative to signals coupled between said third element and said common voltage point, said wavelength corresponding to approximately the average design frequency of said antenna.

7. A switchable array antenna as in claim 6, in which said antenna additionally comprises a protective cover of radiation transmissive material and a base member having a reflective surface serving as a ground plane for said elements.

8. A switchable array antenna as in claim 1 or 2, in which said elements are slots in the form of elongated windows in a conductive surface.

9. A switchable array antenna as in claim 1, in which said elements are slots and said first excitation means comprises two half wavelength transmission lines for coupling between said common voltage point and said first and third elements, respectively, said wavelength corresponding to approximately the average design frequency of said antenna.

10. A switchable array antenna as in claim 1, in which said elements are slots and said first excitation means comprises a full wavelength transmission line coupling to said common voltage point and first and third elements, said wavelength corresponding to approximately the average design frequency of said antenna.

11. A switchable array antenna as in claim 1, in which said elements are slots and said first excitation means comprises two series combinations of two quarter wavelength transformers of different impedances, one such combination for coupling between said common voltage point and each of first and third elements, respectively, said wavelength corresponding to approximately the average design frequency of said antenna.

12. A switchable array antenna as in claim 9, 10 or 11, in which said second excitation means comprises directional coupler means for coupling said middle element signal component to said second element and second tuning means for providing tuning in a desired frequency range.

13. A switchable end-fire array antenna, comprising:

terminal means for coupling signals;

a plurality of antenna elements, comprising a linear array of five monopoles arranged for use in subsets of three, each subset consisting of first, second and third monopole elements;

first excitation mean for coupling signal components from said terminal means only to first and third elements of a subset by way of a point of common voltage included in said first excitation means and for providing radiated signals of opposite phase at said first or said third element relative to the other of said first and third elements;

second excitation means for coupling a signal component from said terminal means only to the second element of said subset with a predetermined phase and amplitude different from said signals coupled to said first and third elements;

tuning means, included in said first excitation means and coupled to said point of common voltage, for providing impedance matching for said first and third elements in a desired frequency range; and shifting means for selectively coupling said first and second excitation means to different subsets of said antenna elements so that said signal components can be respectively shifted to different first, second and third element subsets, each of said subsets consisting of fewer than said plurality of antenna elements;

whereby the effective radiation center of the antenna is selectively shifted along the linear array by activation of said shifting means.

14. A switchable end-fire slot array antenna, comprising:

terminal means for coupling signals;

a plurality of antenna elements, comprising a linear array of five slots arranged for use in subsets of three, each subset consisting of first, second and third slot elements;

first excitation means for coupling signal components from said terminal means only to first and third elements of a subset by way of a point of common voltage included in said first excitation means and for providing radiated signals of opposite phase at said first or said third element relative to the other of said first and third elements;

second excitation means for coupling a signal component from said terminal means only to the second element of said subset with a predetermined phase and amplitude different from said signals coupled to said first and third elements;

tuning means, included in said first excitation means and coupled to said point of common voltage, for providing impendance matching for said first and third elements in a desired frequency range; and shifting means for selectively coupling said first and second excitation means to different subsets of said antenna elements so that said signal components can be respectively shifted to different first, second and third element subsets, each of said subsets consisting of fewer than said plurality of antenna elements;

whereby the effective radiation center of the antenna is selectively shifted along the linear array by activation of said shifting means.

15. A switchable end-fire array antenna as in claim 13 or 14, in which said first excitation means comprises two quarter wavelength transformers for coupling to said first and third elements, said wavelength corresponding to approximately the average design frequency.

16. A switchable end-fire array antenna as in claim 13 or 14, in which said first excitation means comprises two quarter wavelength transformers and a halfwave transmission line, said second excitation means comprises a directional coupler, said wavelength corresponding to approximately the average design frequency.

17. A steerable antenna array system, comprising:

a plurality of switchable array antennas as in claims 1, 2, 4, 9, 10, 11, 13 or 14, said antennas spaced laterally in side-by-side relationship in relation to a first radiation direction; and azimuth control means, coupled to said array antennas, for selectively controlling the shifting means of each one of a plurality of said array antennas to provide selected relative adjustment of said shifting means of two adjacent array antennas;

whereby, the radiation direction and beam shape of said antenna array system, is controlled by relative adjustment of the effective radiation centers of said array antennas.

18. A tilting beam antenna array system, comprising:

an antenna system terminal port for coupling signals;

a plurality of array antennas as in claim 1, 2, 4, 9, 10, 11, 13 or 14, said array antennas being spaced laterally in a first direction and one or more of said array antennas having different displacements in a second direction substantially normal to said first direction;

azimuth control means, coupled to said array antennas, for selectively controlling the shifting means of said array antennas; and beam tilt control means for coupling a selected plurality of said array antennas to said antenna system terminal port;

whereby the antenna beam of said array antenna system can be independently steered in azimuth and tilted.

19. A tilting beam antenna array system as in claim 18, in which said array antenna are on the surface of a vehicle, in the vehicle's normal attitude said first and second directions are substantially horizontal and vertical, respectively, and the beam steering is adapted for effective steering in azimuth with respect to an axis of said vehicle, and the beam tilting is adapted for compensation for vehicle banking.

20. An antenna array system, for providing a steerable beam, comprising:

a first antenna, which is a switchable array antenna providing a substantially end-fire antenna beam in a first direction substantially parallel to a reflective surface, including:

terminal means for coupling signals;

at least four antenna elements spaced from each other along a line in said first direction along a reflecting surface and arranged for use in different subsets, each said subset comprising at least a pair of said antenna elements and each subset consisting of fewer than all of said antenna elements;

excitation means, coupled to said terminal means, for coupling signal components of predetermined relative phase and amplitude to a selected subset consisting of fewer than all of said antenna elements for producing said substantially end-fire antenna beam in said first direction; and shifting means for selectively coupling said excitation means to different selected subsets of said antenna elements, each of said subsets consisting of fewer that all of said antenna elements, for shifting the effective radiation center of said first antenna along said line in said first direction;

one or more additional antennas, each including terminal means, at least four antenna elements, excitation means and shifting means as included in said first antenna and each spaced in a lateral dimension from said first antenna in substantially parallel relation to said first antenna, each of said additional antennas providing a substantially end-fire antenna beam in said first direction substantially parallel to said reflective surface, so that said first and additional antennas are effective to produce a composite beam directed basically in said first direction; and azimuth control means, coupled to said shifting means of said first and additional antennas, for selectively controlling the shifting means of each one of a plurality of said antennas to steer said composite beam in said lateral direction to provide a selected relative adjustment of said shifting means of two adjacent antennas;

whereby, the radiation direction of said composite beam of said antenna array system is controlled by selected relative adjustment of the effective radiation centers of said first and additional antennas by said azimuth control means.

21. An antenna array system as in claim 20, wherein said antenna elements of each of said first and additional antennas are monopoles supported on said reflective surface in a substantially uniformly spaced row of monopoles substantially parallel to said row of monopoles of each other said antenna.

22. An antenna array system as in claim 21, wherein each of said first and additional antennas additionally comprises a protective cover of radiation transmission material and a base member for supporting said monopole antenna elements on said reflective surface.

23. An antenna array system as in claim 20, wherein said antenna elements of each of said first and additional antennas are slots in the form of elongated windows in said reflective surface arranged in a substantially uniformly spaced row of slots substantially parallel to said row of slots of each other said antenna.

24. An antenna array system as in claim 20, wherein said first and additional antennas each include five antenna elements, each said subset consists of three adjacent antenna elements and said one or more additional antennas consists of two laterally spaced antennas substantially parallel to said first antenna.

25. A tilting beam antenna array system comprising:

a first antenna, which is a switchable array antenna providing a substantially end-fire antenna beam in a first direction substantially parallel to a reflective surface, including:

terminal means for coupling signals;

at least four antenna elements spaced from each other along a line in said first direction along a reflecting surface and arranged for use in different subsets, each said subset comprising at least a pair of said antenna elements and each subset consisting of fewer than all of said antenna elements;

excitation means, coupled to said terminal means, for coupling signal components of predetermined relative phase and amplitude to a selected subset, consisting of fewer than all of said antenna elements for producing said substantially end-fire antenna beam in said first direction; and shifting means for selectively coupling said excitation means to different selected subsets of said antenna elements, each of said subsets consisting of fewer than all of said antenna elements and for shifting the effective radiation center of said first antenna along said line in said first direction;

a plurality of additional antennas, each including terminal means, at least four antenna elements, excitation means and shifting means as included in said first antenna and each spaced in a lateral dimension from said first antenna in substantially parallel relation to said first antenna, one or more of said additional antennas having a different displacement from said first antenna in a third dimension which is substantially perpendicular to both said first direction and said lateral dimension;

an array system signal input terminal; and beam tilt control means for coupling a selected plurality of antennas, said plurality consisting of less than all of said first and additional antennas, to said array system signal input terminal;

whereby, the relative displacements of said selected plurality of antennas in said third dimension determines the tilt of the composite beam pattern produced by said selected plurality of array antennas.

26. A tilting beam antenna array system as in claim 25, in which said first and additional antennas are supported on the curved fuselage of an aircraft, said line of antenna elements of each said antenna lies substantially along the longitudinal axis of the aircraft, and said antennas are spaced in said lateral dimension so that the surface curvature of the fuselage results in one or more of said antennas having different vertical displacements in said third dimension substantially normal to said axis and to said lateral dimension.

27. A tilting beam antenna array system as in claim 25, wherein said antenna elements of each of said first and additional antennas are monopoles supported on said reflective surface in a substantially uniformly spaced row of monopoles substantially parallel to said row of monopoles of each other said antenna.

28. A tilting beam antenna array system as in claim 25, wherein said antenna elements of each of said first and additional antennas are slots in the form of elongated windows in said reflective surface arranged in a substantially uniformly spaced row of slots substantially parallel to said row of slots of each other said antenna.

29. A tilting beam antenna array system as in claim 25, additionally including azimuth control means, coupled to said shifting means of said first and additional antennas, for selectively controlling the shifting means of each one of a plurality of said antennas by providing a selected relative adjustment of said shifting means of two adjacent antennas, whereby the antenna beam of said antenna array system can be independently steered in azimuth and tilted.

30. A tilting beam antenna array system as in claim 26, additionally including azimuth control means, coupled to said shifting means of said first and additional antennas, for selectively controlling the shifting means of each one of a plurality of said antennas by providing a selected relative adjustment of said shifting means of two adjacent antennas, whereby the antenna beam of said antenna array system can be independently steered in azimuth and tilted;

whereby, steering the beam in azimuth is effective for scanning the beam relative to said longitudinal axis of said aircraft and tilting the beam is effective for compensating for banking of said aircraft.

31. A steerable aircraft antenna array system, for providing a composite forward beam pattern which is steerable relative to a longitudinal aircraft axis, comprising:

a section of the outer surface of an aircraft;

a plurality of switchable end-fire array antenna in side-by-side relationship spaced laterally in relation to said longitudinal aircraft axis, each such array antenna comprising:

a linear array of antenna elements spaced along a longitudinal antenna axis extending in the same dimension as said longitudinal aircraft axis and supported by said section of the outer surface of said aircraft;

excitation means for coupling signal components to and from a selected subset of antenna elements consisting of less than all of said elements of said array antenna, including a point of common voltage coupled to at least two of said antenna elements of said array antenna and tuning means coupled to said point of common voltage for providing impedance matching for each antenna element coupled to said point of common voltage;

a common antenna terminal port, coupled to said excitation means, for coupling signals to and from all of said antenna elements of said selected subset; and shifting means, coupled to said excitation means, for causing the coupling of signal components to be shifted to different subsets of less than all of said elements so as to selectively shift the effective radiation center of said array antenna along its longitudinal antenna axis;

azimuth control means, coupled to said array antennas, for steering said composite forward beam pattern relative to said longitudinal aircraft axis by selectively controlling the shifting means of each one of a plurality of said array antennas to provide a selected relative adjustment of the effective radiation centers of at least two adjacent array antennas; and a common antenna system terminal port for coupling signals to and from all active ones of said common antenna terminal ports.

32. A steerable aircraft antenna array system as in claim 31, in which each of said antenna elements of each of said switchable end-fire array antennas is a monopole approximately one-tenth wavelength in height, said wavelength corresponding to approximately the average design frequency of said antenna system.

33. A steerable aircraft antenna array system as in claim 31, in which each of said antenna elements of each of said switchable end-fire array antennas is a slot in the form of an elongated window in said section of the outer surface of said aircraft.

34. A steerable aircraft antenna array system as in claim 31, in which the plurality of switchable end-fire array antennas is three array antennas and each linear array of antenna elements includes five antenna elements.

35. A tilting beam aircraft antenna array system for providing a composite forward beam pattern which may be tilted as an aircraft rolls about the longitudinal aircraft axis, comprising:

a section of the outer surface of the fuselage of said aircraft, said section extending at least partially around said longitudinal aircraft axis;

a plurality of end-fire array antennas in side-by-side relationship spaced laterally in relation to said longitudinal aircraft axis and one or more of said array antennas having different vertical displacements, substantially normal to said lateral spacing and said longitudinal aircraft axis, as a result of said section extending partially around said longitudinal aircraft axis, each such array antenna comprising:

a linear array of antenna elements spaced along a longitudinal antenna axis extending in the same dimension as said longitudinal aircraft axis and supported by said section of the outer surface of said fuselage;

excitation means for coupling signal components to antenna elements of said array antenna, including a point of common voltage coupled to at least two of said antenna elements of said array antenna and tuning means coupled to said point of common voltage for providing impedance matching for each antenna element coupled to said point of common voltage; and a common antenna terminal port, coupled to said excitation means, for coupling signals to and from said antenna elements of said array antenna;

a common antenna system terminal port for coupling signals to and from said antenna terminal ports; and beam tilt control means for coupling a selected group of said array antennas, said group consisting of less than all of said plurality of said array antennas, to said common antenna system terminal port;

the arrangement being such that the relative vertical displacements of the selected group of array antennas determine the tilt of the composite forward beam pattern.

36. A tilting beam aircraft antenna array system as in claim 35, in which each of said antenna elements of each of said end-fire array antennas is a monopole approximately one-tenth wavelength in height, said wavelength corresponding to approximately the average design frequency of said antenna system.

37. A tilting beam aircraft antenna array system, for providing a composite forward beam pattern which may be tilted as an aircraft rolls about the longitudinal aircraft axis, comprising:

a section of the outer surface of the fuselage of said aircraft, said section extending at least partially around said longitudinal aircraft axis;

a plurality of end-fire array antennas in side-by-side relationship spaced laterally in relation to said longitudinal aircraft axis and one or more of said array antennas having different vertical displacements as a result of said section extending partially around said longitudinal aircraft axis, each such array antenna comprising:

a linear array of antenna elements spaced along a longitudinal antenna axis extending in the same dimension as said longitudinal aircraft axis and supported by said section of the outer surface of said fuselage;

excitation means for coupling signal components to and from a selected subset of antenna elements consisting of less than all of said elements of said array antenna, including a point of common voltage coupled to at least two of said antenna elements of said array antenna and tuning means coupled to said point of common voltage for providing impedance matching for each antenna element coupled to said point of common voltage;

a common antenna terminal port, coupled to said excitation means, for coupling signals to and from all of said antenna elements of said selected subset; and shifting means, coupled to said excitation means, for causing the coupling of signal components to be shifted to different subsets of less than all of said elements so as to selectively shift the effective radiation center of said array antenna along its longitudinal antenna axis;

azimuth control means, coupled to said array antennas, for steering said composite forward beam pattern relative to said longitudinal aircraft axis by selectively controlling the shifting means of each one of a plurality of said array antennas to provide a selected relative adjustment of the effective radiation centers of at least two adjacent array antennas;

a common antenna system terminal port for coupling signals to and from said antenna terminal ports; and beam tilt control means for coupling a selected group of said array antennas, said group consisting of less than all of said plurality of said array antennas, to said common antenna system terminal port;

the arrangement being such that the relative vertical displacements of the selected group of array antennas determine the tilt of the composite forward beam pattern.

38. A tilting beam aircraft antenna array system as in claim 37, in which said plurality of array antennas is seven antennas and said beam tilt control means couples a selected plurality of three adjacent array antennas to said common antenna system terminal port.

* * * * *